US010731258B2

(12) United States Patent
Thottathil et al.

(10) Patent No.: US 10,731,258 B2
(45) **Date of Patent: *Aug. 4, 2020**

(54) PLATING BATH SOLUTIONS

(71) Applicant: Surface Technology, Inc., Ewing, NJ (US)

(72) Inventors: Jijeesh Thottathil, Mercerville, NJ (US); Thomas S. Lancsek, Trenton, NJ (US); Michael David Feldstein, Princeton, NJ (US)

(73) Assignee: Surface Technology, Inc., Ewing, NJ (US)

( * ) Notice: Subject to any disclaimer, the term of this patent is extended or adjusted under 35 U.S.C. 154(b) by 161 days.

This patent is subject to a terminal disclaimer.

(21) Appl. No.: 15/977,458

(22) Filed: May 11, 2018

(65) Prior Publication Data

US 2018/0258538 A1 Sep. 13, 2018

Related U.S. Application Data

(63) Continuation-in-part of application No. 15/953,914, filed on Apr. 16, 2018, which is a continuation of application No. 14/876,144, filed on Oct. 6, 2015, now Pat. No. 10,061,126.

(60) Provisional application No. 62/177,994, filed on Mar. 30, 2015, provisional application No. 62/123,758, filed on Nov. 28, 2014, provisional application No. 62/122,619, filed on Oct. 27, 2014.

(51) Int. Cl.
*C23C 18/36* (2006.01)
*C23C 18/16* (2006.01)

(52) U.S. Cl.
CPC ..... *C23C 18/36* (2013.01); *C23C 18/1617* (2013.01); *C23C 18/1662* (2013.01); *C23C 18/1683* (2013.01)

(58) Field of Classification Search
None
See application file for complete search history.

(56) References Cited

U.S. PATENT DOCUMENTS

| | | | | |
|---|---|---|---|---|
| 3,649,350 | A * | 3/1972 | Agens | C23C 18/40 148/679 |
| 3,977,884 | A | 8/1976 | Gulla | |
| 4,061,802 | A * | 12/1977 | Costello | C23C 18/36 427/304 |
| 4,353,933 | A * | 10/1982 | Araki | C23C 18/1617 118/690 |
| 4,462,874 | A | 7/1984 | Tomaszewski et al. | |
| 4,469,569 | A | 9/1984 | Tomaszewski et al. | |
| 4,483,711 | A | 11/1984 | Harbulak et al. | |
| 5,300,330 | A | 4/1994 | Feldstein et al. | |
| 5,609,767 | A | 3/1997 | Eisenmann | |
| 5,635,253 | A * | 6/1997 | Canaperi | C23C 18/1617 427/437 |
| 6,281,157 | B1 | 8/2001 | Tangi et al. | |
| 6,306,466 | B1 | 10/2001 | Feldstein | |
| 6,500,482 | B1 * | 12/2002 | Morcos | C23C 18/1617 427/438 |
| 7,744,685 | B2 | 6/2010 | Lancsek et al. | |
| 7,968,149 | B2 | 6/2011 | Takagami et al. | |
| 8,147,601 | B2 * | 4/2012 | Feldstein | C23C 18/31 106/1.22 |
| 8,328,919 | B2 | 12/2012 | Kolics | |
| 10,006,126 | B2 * | 6/2018 | Thottathil | C23C 18/36 |
| 2004/0258847 | A1 * | 12/2004 | Bayes | C23C 18/1617 427/430.1 |
| 2004/0258848 | A1 * | 12/2004 | Fukunaga | C23C 18/32 427/430.1 |
| 2006/0251910 | A1 | 11/2006 | Lancsek et al. | |
| 2009/0011136 | A1 * | 1/2009 | Lancsek | C23C 18/31 427/443.1 |
| 2016/0168718 | A1 * | 6/2016 | Lee | C23C 18/34 428/457 |
| 2018/0258537 | A1 * | 9/2018 | Thottathil | C23C 18/36 |
| 2018/0258538 | A1 * | 9/2018 | Thottathil | C23C 18/1683 |

FOREIGN PATENT DOCUMENTS

| | | | |
|---|---|---|---|
| CN | 102471918 | A | 5/2012 |
| DE | 2744426 | A1 * | 4/1979 |
| JP | 2001/049448 | A * | 2/2001 |

OTHER PUBLICATIONS

Written Opinion of the International Search Authority dated Jan. 4, 2016 for PCT/US2015/056840; 5 pages.*
International Preliminary Report dated May 10, 2016 for PCT/US2015/056840; 9 pages.*
English translation of JP 2001/049448, Feb. 2001; 21 pages.*
English translation of DE 2744426, Apr. 1979; 7 pages.*
Peter D. Longfield, Rick Rauppius and Werner Richtering; Novel Long-Life Electroless Nickel with Continuous Regeneration by Electrodialysis; Metal Finishing; May 2001, pp. 36-43; vol. 99; Issue 5; Atotech USA Inc., Rock Hill, S.C., and Atotech Germany, Berlin.
Boules Morcos, Mike Barnstead; Electroless Nickel Plating, PF Products Finishing; 2011.
Extending Electroless Nickel Bath Life Using Electrodialysis; U.S. Environmental Protection Agency Region 9 Pollution Prevention Program; Jul. 1998.
Chris Steffani, Michael Meltzer; Electroless Nickel Recycling Via Electro-Dialysis; Pollution Prevention Group, Environmental Protection Department Lawrence Livermore National Laboratory; pp. 1-7; Apr. 1995.
V. Markovac and H.C. Heller; Principles of Electrodialysis For Nickel-Plating Rinsewater; Plating and Surface Finishing; pp. 66-69; Dec. 1981.
U.S./ISA, International Search Report dated Jan. 4, 2016 issued in corresponding PCT International Application No. PCT/US2015/056840 filed Oct. 22, 2015.

(Continued)

*Primary Examiner* — Helene Klemanski
(74) *Attorney, Agent, or Firm* — Gottlieb Rackman & Reisman PC

(57) ABSTRACT

The present invention is directed to compositions for electroless plating baths and their use, and more particularly to different solutions or concentrates each usable to both make up an original bath and to replenishment of the original bath.

20 Claims, 5 Drawing Sheets

(56) References Cited

OTHER PUBLICATIONS

EPO, Extended European Search Report dated May 3, 2018 issued in corresponding European Patent Application No. 15855487.3 filed Sep. 6, 2017.
SIPO, Patent Office Action of the People's Republic of China dated May 22, 2018 issued in corresponding Chinese Patent Application No. 201580064962.6 filed Oct. 22, 2015.

* cited by examiner

| | A | B | C | D | E | F | G | H | I | J | K | L | M |
|---|---|---|---|---|---|---|---|---|---|---|---|---|---|
| 4 | | **Example number** | | 1 | 2 | 3 | 4 | 5 | 6 | 7 | 8 | 9 | 10 |
| 5 | **Component Type** | **Component** | **Unit** | Quantity in the solution | Quantity in the solution | Quantity in the solution | Quantity in the solution | Quantity in the solution | Quantity in the solution | Quantity in the solution | Quantity in the solution | Quantity in the solution | Quantity in the solution |
| 6 | Complexer | Lactic Acid | g/L | 82.4 | 82.4 | 82.4 | 65.92 | 57.7 | 57.7 | 57.7 | 57.7 | 57.7 | 82.4 |
| 7 | Complexer | Malic Acid | g/L | 48.3 | 48.3 | 48.3 | 38.6 | 33.8 | 33.8 | 33.8 | 33.8 | 33.8 | 48.3 |
| 8 | Buffer | Borax | g/L | 38.8 | 38.8 | 77.6 | 31.04 | 27.2 | 27.2 | 27.2 | 27.2 | 27.2 | 38.8 |
| 9 | Buffer/Complexer | Boric Acid | g/L | | | | | | | | | | |
| 10 | Buffer/Complexer | Tetra Potassium Pyrophosphate | g/L | | | | | | | | | | |
| 11 | Complexer | Glycine | g/L | | | | | | | | | | |
| 12 | Complexer | Citric Acid | g/L | | | | | | | | | | |
| 13 | Complexer | Succinic Acid | g/L | | | | | | | | | | |
| 14 | Complexer | Acetic Acid | ml/L | 50 | | | | | | | | | |
| 15 | Complexer | Glycolic Acid | ml/l | | | | | | | | | | |
| 16 | Reducing | Sodium Hypophosphite | g/L | 150 | 150 | 150 | 100 | 90 | 90 | 90 | 90 | 90 | 150 |
| 17 | Reducing | DMAB | g/L | | | | | | | | | | |
| 18 | Metal Salt | Nickel Sulfate (5#/Gallon) | ml/L | 225 | 225 | 225 | 112 | 112 | 112 | 112 | 112 | 112 | 225 |
| 19 | Metal Salt | Nickel Chloride | g/l | | | | | | | | | | |
| 20 | Metal Salt | Cobalt Chloride | g/L | | | | | | | | | | |
| 21 | pH Adjuster | Ammonium Hydroxide | ml/L | | | | | | | | | | |
| 22 | pH Adjuster | Sodium Hydroxide | g/L | 31.5 | 31.5 | 31.5 | 25.2 | 22.1 | 22.1 | 22.1 | 22.1 | 22.1 | 31.5 |
| 23 | pH Adjuster | Ammonium Acetate | g/l | | | | | | | | | | |
| 24 | pH Adjuster | Ammonium Chloride | g/L | | | | | | | | | | |
| 25 | Accelerator | Methyl Thiourea | ppm | | | | | | | | | | |
| 26 | Stabilizer | Lead | ppm | | | | | | | 2.5 | | | |
| 27 | Stabilizer | Bismuth | ppm | 5 | 10 | 10 | 10 | 10 | 5 | 5 | 5 | 5 | |
| 28 | Stabilizer | Thiourea | ppm | 8 | 15 | 15 | 16 | 16 | 8 | 8 | 8 | 8 | 15 |
| 29 | Stabilizer | Thiosalicylic | ppm | | | | | | | | | | |
| 30 | Stabilizer | Thiodiglycolic Acid | ppm | | | | | | | | | | |
| 31 | Stabilizer | Copper | ppm | | | | | | | | | | |
| 32 | Stabilizer | Ortho iodo benzoic acid | ppm | | | | | | | | | | |
| 33 | Stabilizer | Fumaric Acid | g/L | | | | | | | | | | |
| 34 | Stabilizer | Maleic Acid | g/L | | | | | | | | | | |
| 35 | Stabilizer | 2-Aminothiazol | ppm | | | | | | | | | | |
| 36 | Stabilizer | Sodium Thiocyanate | ppm | | | | | | | | | | |
| 37 | Brightener | Cadmium | ppm | | | | | | | | | 2.5 | |
| 38 | PMS | 4-butyl 1,4 diol | ppm | | | | | | | | | | 50 |
| 39 | PMS | Anionic Wetting Agent | ml/l | | | | | | | | 0.25 | | |
| 40 | Particulate | Boron Nitride | g/L | | | | | | | | | | |
| 41 | Particulate | PTFE Dispersion | g/L | | | | | | | | | | |
| 42 | Particulate | Diamond | g/L | | | | | | | | | | |
| 43 | Particulate | Silicon Carbide | g/L | | | | | | | | | | |
| 44 | | | | | | | | | | | | | |
| 45 | | **Plating Parameters** | | | | | | | | | | | |
| 46 | | Solution Usage / Liter | ml | 200 | 200 | 200 | 200 | 200 | 200 | 200 | 200 | 200 | 200 |
| 47 | | pH | | 4.9 | 4.9 | 4.9 | 4.9 | 4.9 | 4.9 | 4.9 | 4.9 | 4.9 | 4.9 |
| 48 | | Temperature | °C | 90 | 90 | 90 | 90 | 90 | 90 | 90 | 90 | 90 | 90 |
| 49 | | Plating rate | mils/hr | 0.8 | 0.8 | 0.8 | 0.6 | 0.6 | 0.6 | 0.5 | 0.6 | 0.6 | 0.7 |

FIG. 1A
(Chart 1)

| | A | B | C | N | O | P | Q | R | S | T | U | V | W |
|---|---|---|---|---|---|---|---|---|---|---|---|---|---|
| 4 | | Example number | | 11 | 12 | 13 | 14 | 15 | 16 | 17 | 18 | 18 | 19 |
| 5 | **Component Type** | **Component** | **Unit** | Quantity in the solution | Quantity in the solution | Quantity in the solution | Quantity in the solution | Quantity in the solution | Quantity in the solution | Quantity in the solution | Quantity in the solution | Quantity in the solution | Quantity in the solution |
| 6 | Complexer | Lactic Acid | g/L | 82.4 | 82.4 | 82.4 | 82.4 | 82.4 | 82.4 | 82.4 | 82.4 | 82.4 | 82.4 |
| 7 | Complexer | Malic Acid | g/L | 48.3 | 48.3 | 48.3 | 48.3 | 48.3 | 48.3 | 48.3 | 48.3 | 48.3 | 48.3 |
| 8 | Buffer | Borax | g/L | 38.8 | 38.8 | 38.8 | 38.8 | 38.8 | 38.8 | 38.8 | 38.8 | 38.8 | 38.8 |
| 9 | Buffer/Complexer | Boric Acid | g/L | | | | | | | | | | |
| 10 | Buffer/Complexer | Tetra Potassium Pyrophosphate | g/L | | | | | | | | | | |
| 11 | Complexer | Glycine | g/L | | | | | | | | | 75 | 25 |
| 12 | Complexer | Citric Acid | g/L | | | | | | | | | | |
| 13 | Complexer | Succinic Acid | g/L | | | | | | | | | | |
| 14 | Complexer | Acetic Acid | ml/L | | | | | | | | | | |
| 15 | Complexer | Glycolic Acid | ml/l | | | | | | | | | | |
| 16 | Reducing | Sodium Hypophosphite | g/L | 150 | 150 | 150 | 150 | 150 | 150 | 150 | 150 | 150 | 150 |
| 17 | Reducing | DMAB | g/L | | | | | | | | | | |
| 18 | Metal Salt | Nickel Sulfate (5#/Gallon) | ml/L | 225 | 225 | 225 | 225 | 225 | 225 | 225 | 225 | 225 | 225 |
| 19 | Metal Salt | Nickel Chloride | g/l | | | | | | | | | | |
| 20 | Metal Salt | Cobalt Chloride | g/L | | | | | | | | | | |
| 21 | pH Adjuster | Ammonium Hydroxide | ml/L | | | | | | | | | | |
| 22 | pH Adjuster | Sodium Hydroxide | g/L | 31.5 | 31.5 | 31.5 | 31.5 | 31.5 | 31.5 | 31.5 | 31.5 | 31.5 | 31.5 |
| 23 | pH Adjuster | Ammonium Acetate | g/l | | | | | | | | | | |
| 24 | pH Adjuster | Ammonium Chloride | g/L | | | | | | | | | | |
| 25 | Accelerator | Methyl Thiourea | ppm | | | | | | | | | | |
| 26 | Stabilizer | Lead | ppm | | | | | | | | | | |
| 27 | Stabilizer | Bismuth | ppm | 15 | 25 | 25 | 15 | 7.5 | 10 | 7.5 | 15 | 15 | 15 |
| 28 | Stabilizer | Thiourea | ppm | | | | | | 16 | 7.5 | | | |
| 29 | Stabilizer | Thiosalicylic | ppm | 30 | 40 | 100 | 30 | 15 | | | 15 | 15 | 15 |
| 30 | Stabilizer | Thiodiglycolic Acid | ppm | | | | | | | | | | |
| 31 | Stabilizer | Copper | ppm | | | | | | | | | | |
| 32 | Stabilizer | Ortho iodo benzoic acid | ppm | | | | | | | | | | |
| 33 | Stabilizer | Fumaric Acid | g/L | | | | | | | | | | |
| 34 | Stabilizer | Maleic Acid | g/L | | | | | | | | | | |
| 35 | Stabilizer | 2-Aminothiazol | ppm | | | | | | | | | | |
| 36 | Stabilizer | Sodium Thiocyanate | ppm | | | | | | | | | | |
| 37 | Brightener | Cadmium | ppm | | | | | | | | | | |
| 38 | PMS | 4-butyl 1,4 diol | ppm | | | | | | | | | | |
| 39 | PMS | Anionic Wetting Agent | ml/l | | | | | | | | | | |
| 40 | Particulate | Boron Nitride | g/L | | | | 53 | 53 | | | 42 | 42 | 42 |
| 41 | Particulate | PTFE Dispersion | g/L | | | | | | 27 | 22.5 | | | |
| 42 | Particulate | Diamond | g/L | | | | | | | | | | |
| 43 | Particulate | Silicon Carbide | g/L | | | | | | | | | | |
| 44 | | | | | | | | | | | | | |
| 45 | | **Plating Parameters** | | | | | | | | | | | |
| 46 | | Solution Usage / Liter | ml | 200 | 200 | 200 | 200 | 200 | 200 | 200 | 200 | 200 | 200 |
| 47 | | pH | | 4.9 | 4.9 | 4.9 | 4.9 | 4.9 | 4.9 | 4.9 | 6 | 5 | 5 |
| 48 | | Temperature | °C | 90 | 90 | 90 | 90 | 90 | 90 | 90 | 85 | 90 | 90 |
| 49 | | Plating rate | mils/hr | 0.6 | 0.6 | 0.5 | 0.6 | 0.6 | 0.4 | 0.4 | 0.5 | 0.6 | 0.6 |

FIG. 1B
(Chart 1)

| | A | B | C | X | Y | Z | AA | AB | AC | AD | AE | AF | AG |
|---|---|---|---|---|---|---|---|---|---|---|---|---|---|
| 4 | | **Example number** | | 20 | 21 | 22 | 23 | 24 | 25 | 26 | 27 | 28 | 29 |
| 5 | **Component Type** | **Component** | **Unit** | Quantity in the solution | Quantity in the solution | Quantity in the solution | Quantity in the solution | Quantity in the solution | Quantity in the solution | Quantity in the solution | Quantity in the solution | Quantity in the solution | Quantity in the solution |
| 6 | Complexer | Lactic Acid | g/L | 82.4 | 82.4 | 82.4 | 82.4 | 57.7 | 82.4 | 82.4 | 82.4 | | 165 |
| 7 | Complexer | Malic Acid | g/L | 48.3 | 48.3 | 48.3 | 48.3 | 33.8 | 48.3 | 48.3 | 48.3 | 159.6 | 96.5 |
| 8 | Buffer | Borax | g/L | 38.8 | 38.8 | 38.8 | 38.8 | 27.2 | 38.8 | 38.8 | 38.8 | | |
| 9 | Buffer/Complexer | Boric Acid | g/L | | | | | | | | | | |
| 10 | Buffer/Complexer | Tetra Potassium Pyrophosphate | g/L | | | | | | | | | | |
| 11 | Complexer | Glycine | g/L | | 75 | 75 | 75 | | | | 75 | | |
| 12 | Complexer | Citric Acid | g/L | | | | | | | | | 26.5 | |
| 13 | Complexer | Succinic Acid | g/L | | | | | | | | | 29.3 | |
| 14 | Complexer | Acetic Acid | ml/L | | | | | | | | | | |
| 15 | Complexer | Glycolic Acid | ml/l | | | | | | | | | | |
| 16 | Reducing | Sodium Hypophosphite | g/L | 150 | 150 | 150 | 150 | 90 | 150 | 150 | 150 | 200 | 200 |
| 17 | Reducing | DMAB | g/L | | | | | | | | | | |
| 18 | Metal Salt | Nickel Sulfate (5#/Gallon) | ml/L | 225 | 225 | 225 | 225 | 112 | 225 | 225 | 225 | 300 | 300 |
| 19 | Metal Salt | Nickel Chloride | g/l | | | | | | | | | | |
| 20 | Metal Salt | Cobalt Chloride | g/L | | | | | | | | | | |
| 21 | pH Adjuster | Ammonium Hydroxide | ml/L | | | | | 16.5 | | | | | |
| 22 | pH Adjuster | Sodium Hydroxide | g/L | 31.5 | 31.5 | 31.5 | 31.5 | | 31.5 | 31.5 | 31.5 | 108 | 62.9 |
| 23 | pH Adjuster | Ammonium Acetate | g/l | | | | | | | | | | |
| 24 | pH Adjuster | Ammonium Chloride | g/L | | | | | | | | | | |
| 25 | Accelerator | Methyl Thiourea | ppm | | | | 5 | | | | | | |
| 26 | Stabilizer | Lead | ppm | | | | | | | | | | |
| 27 | Stabilizer | Bismuth | ppm | 15 | 15 | 15 | 15 | 10 | 5 | 5 | 10 | | |
| 28 | Stabilizer | Thiourea | ppm | | | | | 16 | 5 | 10 | | | |
| 29 | Stabilizer | Thiosalicylic | ppm | 30 | 15 | 15 | 15 | | | | | | |
| 30 | Stabilizer | Thiodiglycolic Acid | ppm | | | | | | | | | | |
| 31 | Stabilizer | Copper | ppm | | | | | | | | | 47.3 | 47.3 |
| 32 | Stabilizer | Ortho iodo benzoic acid | ppm | | | | | | | | | 40 | 40 |
| 33 | Stabilizer | Fumaric Acid | g/L | | | | | | | | | | |
| 34 | Stabilizer | Maleic Acid | g/L | | | | | | | | | | |
| 35 | Stabilizer | 2-Aminothiazol | ppm | | | | | | | | | | |
| 36 | Stabilizer | Sodium Thiocyanate | ppm | | | | | | | | | | |
| 37 | Brightener | Cadmium | ppm | | | | | | | | | | |
| 38 | PMS | 4-butyl 1,4 diol | ppm | | | | | | | | | | |
| 39 | PMS | Anionic Wetting Agent | ml/l | 0.1 | 0.1 | 0.1 | 0.1 | | | | | | |
| 40 | Particulate | Boron Nitride | g/L | | | | | | | | | | |
| 41 | Particulate | PTFE Dispersion | g/L | | | | | | 25.5 | 25.5 | 25.5 | | |
| 42 | Particulate | Diamond | g/L | 35 | 35 | | | | | | | | |
| 43 | Particulate | Silicon Carbide | g/L | | | 35 | 35 | | | | | | |
| 44 | | | | | | | | | | | | | |
| 45 | | **Plating Parameters** | | | | | | | | | | | |
| 46 | | Solution Usage / Liter | ml | 200 | 200 | 200 | 200 | 200 | 200 | 200 | 200 | 150 | 150 |
| 47 | | pH | | 4.9 | 4.9 | 4.9 | 4.9 | 4.9 | 4.9 | 4.9 | 4.9 | 4.9 | 4.9 |
| 48 | | Temperature | °C | 90 | 90 | 90 | 90 | 90 | 90 | 90 | 90 | 90 | 90 |
| 49 | | Plating rate | mils/hr | 0.6 | 0.6 | 0.6 | 0.7 | 0.6 | 0.2 | 0.3 | 0.3 | 0.45 | 0.5 |

FIG. 1C
(Chart 1)

| | A | B | C | AH | AI | AJ | AK | AL | AM | AN | AO | AP | AQ |
|---|---|---|---|---|---|---|---|---|---|---|---|---|---|
| 4 | | **Example number** | | 30 | 31 | 32 | 33 | 34 | 35 | 36 | 37 | 38 | 39 |
| 5 | **Component Type** | **Component** | **Unit** | Quantity in the solution | Quantity in the solution | Quantity in the solution | Quantity in the solution | Quantity in the solution | Quantity in the solution | Quantity in the solution | Quantity in the solution | Quantity in the solution | Quantity in the solution |
| 6 | Complexer | Lactic Acid | g/L | 165 | 165 | | | | | | | | |
| 7 | Complexer | Malic Acid | g/L | 96.5 | 96.5 | 90 | | | 120 | 120 | 159.6 | 186.7 | |
| 8 | Buffer | Borax | g/L | | | | | | | | | | |
| 9 | Buffer/Complexer | Boric Acid | g/L | | | | | | | | | | 120 |
| 10 | Buffer/Complexer | Tetra Potassium Pyrophosphate | g/L | | | | | | | | | | 160 |
| 11 | Complexer | Glycine | g/L | | | | | | | | | | |
| 12 | Complexer | Citric Acid | g/L | | | 8 | 32.6 | 65.2 | 8 | 8 | 26.5 | 31.3 | |
| 13 | Complexer | Succinic Acid | g/L | | | | | | 13.4 | 13.4 | 29.3 | 34.6 | |
| 14 | Complexer | Acetic Acid | ml/L | | | 6 | | | | | | | |
| 15 | Complexer | Glycolic Acid | ml/l | | | | 53 | 106 | | | | | |
| 16 | Reducing | Sodium Hypophosphite | g/L | 200 | 200 | 200 | | | 200 | 200 | 200 | 236 | 120 |
| 17 | Reducing | DMAB | g/L | | | | 10 | 10 | | | | | |
| 18 | Metal Salt | Nickel Sulfate (5#/Gallon) | ml/L | 300 | 300 | 300 | | | 300 | 300 | 300 | 354 | 180 |
| 19 | Metal Salt | Nickel Chloride | g/l | | | | 48 | 48 | | | | | |
| 20 | Metal Salt | Cobalt Chloride | g/L | | | | | | | | | | |
| 21 | pH Adjuster | Ammonium Hydroxide | ml/L | | | | | | | | | | 146 |
| 22 | pH Adjuster | Sodium Hydroxide | g/L | 62.9 | 62.9 | 86 | | | 200 | 200 | 108 | 127.4 | |
| 23 | pH Adjuster | Ammonium Acetate | g/l | | | | 87.5 | 175 | | | | | |
| 24 | pH Adjuster | Ammonium Chloride | g/L | | | | 10 | | | | | | |
| 25 | Accelerator | Methyl Thiourea | ppm | | | | | | | | | | |
| 26 | Stabilizer | Lead | ppm | | | | | | | | | | 12 |
| 27 | Stabilizer | Bismuth | ppm | | 10 | 15 | | | | | 10 | | |
| 28 | Stabilizer | Thiourea | ppm | | | | | | | | | | |
| 29 | Stabilizer | Thiosalicylic | ppm | | | | | | | | | | |
| 30 | Stabilizer | Thiodiglycolic Acid | ppm | | | | 240 | 240 | | | | | |
| 31 | Stabilizer | Copper | ppm | 167 | | | | | 66.7 | 66.7 | | 55.8 | |
| 32 | Stabilizer | Ortho iodo benzoic acid | ppm | 40 | | | | | | | | 47.2 | |
| 33 | Stabilizer | Fumaric Acid | g/L | | | | | | | 6 | | | |
| 34 | Stabilizer | Maleic Acid | g/L | | | | | | 6 | | | | |
| 35 | Stabilizer | 2-Aminothiazol | ppm | | | | | | | | 0.5 | | |
| 36 | Stabilizer | Sodium Thiocyanate | ppm | | | | | | | | | | 20 |
| 37 | Brightener | Cadmium | ppm | | | | 5.4 | 5.4 | | | | | |
| 38 | PMS | 4-butyl 1,4 diol | ppm | | | | | | | | | | |
| 39 | PMS | Anionic Wetting Agent | ml/l | | | | 0.2 | 0.2 | | | | | |
| 40 | Particulate | Boron Nitride | g/L | | | | | | | | | | |
| 41 | Particulate | PTFE Dispersion | g/L | | | | | | | | | | |
| 42 | Particulate | Diamond | g/L | | | | | | | | | | |
| 43 | Particulate | Silicon Carbide | g/L | | | | | | | | | | |
| 44 | | | | | | | | | | | | | |
| 45 | | **Plating Parameters** | | | | | | | | | | | |
| 46 | | Solution Usage / Liter | ml | 150 | 150 | 150 | 250 | 250 | 150 | 150 | 150 | 125 | 250 |
| 47 | | pH | | 4.9 | 4.9 | 4.9 | 6.3 | 6.3 | 4.9 | 4.9 | 4.9 | 4.9 | 10 |
| 48 | | Temperature | °C | 90 | 90 | 90 | 80 | 80 | 90 | 90 | 90 | 90 | 80 |
| 49 | | Plating rate | mils/hr | 0.5 | 0.6 | 0.55 | 0.2 | 0.2 | 0.3 | 0.3 | 0.45 | 0.45 | 0.6 |

FIG. 1D
(Chart 1)

| | A | B | C | AR | AS |
|---|---|---|---|---|---|
| 4 | | **Example number** | | 40 | |
| 5 | **Component Type** | **Component** | **Unit** | Quantity in the solution | **Component** |
| 6 | Complexer | Lactic Acid | g/L | | Lactic Acid |
| 7 | Complexer | Malic Acid | g/L | | Malic Acid |
| 8 | Buffer | Borax | g/L | | Borax |
| 9 | Buffer/Complexer | Boric Acid | g/L | | Boric Acid |
| 10 | Buffer/Complexer | Tetra Potassium Pyrophosphate | g/L | | Tetra Potassium Pyrophosphate |
| 11 | Complexer | Glycine | g/L | | Glycine |
| 12 | Complexer | Citric Acid | g/L | 25 | Citric Acid |
| 13 | Complexer | Succinic Acid | g/L | | Succinic Acid |
| 14 | Complexer | Acetic Acid | ml/L | 33.3 | Acetic Acid |
| 15 | Complexer | Glycolic Acid | ml/l | 58.3 | Glycolic Acid |
| 16 | Reducing | Sodium Hypophosphite | g/L | | Sodium Hypophosphite |
| 17 | Reducing | DMAB | g/L | 8.3 | DMAB |
| 18 | Metal Salt | Nickel Sulfate (5#/Gallon) | ml/L | | Nickel Sulfate (5#/Gallon) |
| 19 | Metal Salt | Nickel Chloride | g/l | | Nickel Chloride |
| 20 | Metal Salt | Cobalt Chloride | g/L | 100 | Cobalt Chloride |
| 21 | pH Adjuster | Ammonium Hydroxide | ml/L | 100 | Ammonium Hydroxide |
| 22 | pH Adjuster | Sodium Hydroxide | g/L | | Sodium Hydroxide |
| 23 | pH Adjuster | Ammonium Acetate | g/l | | Ammonium Acetate |
| 24 | pH Adjuster | Ammonium Chloride | g/L | | Ammonium Chloride |
| 25 | Accelerator | Methyl Thiourea | ppm | | Methyl Thiourea |
| 26 | Stabilizer | Lead | ppm | | Lead |
| 27 | Stabilizer | Bismuth | ppm | | Bismuth |
| 28 | Stabilizer | Thiourea | ppm | | Thiourea |
| 29 | Stabilizer | Thiosalicylic | ppm | | Thiosalicylic |
| 30 | Stabilizer | Thiodiglycolic Acid | ppm | 30 | Thiodiglycolic Acid |
| 31 | Stabilizer | Copper | ppm | | Copper |
| 32 | Stabilizer | Ortho iodo benzoic acid | ppm | | Ortho iodo benzoic acid |
| 33 | Stabilizer | Fumaric Acid | g/L | | Fumaric Acid |
| 34 | Stabilizer | Maleic Acid | g/L | | Maleic Acid |
| 35 | Stabilizer | 2-Aminothiazol | ppm | | 2-Aminothiazol |
| 36 | Stabilizer | Sodium Thiocyanate | ppm | | Sodium Thiocyanate |
| 37 | Brightener | Cadmium | ppm | 3.3 | Cadmium |
| 38 | PMS | 4-butyl 1,4 diol | ppm | | 4-butyl 1,4 diol |
| 39 | PMS | Anionic Wetting Agent | ml/l | | Anionic Wetting Agent |
| 40 | Particulate | Boron Nitride | g/L | | Boron Nitride |
| 41 | Particulate | PTFE Dispersion | g/L | | PTFE Dispersion |
| 42 | Particulate | Diamond | g/L | | Diamond |
| 43 | Particulate | Silicon Carbide | g/L | | Silicon Carbide |
| 44 | | | | | |
| 45 | | **Plating Parameters** | | | **Plating Parameters** |
| 46 | | Solution Usage / Liter | ml | 300 | Solution Usage / Liter |
| 47 | | pH | | 6.1 | pH |
| 48 | | Temperature | °C | 80 | Temperature |
| 49 | | Plating rate | mils/hr | 0.4 | Plating rate |

FIG. 1E
(Chart 1)

PLATING BATH SOLUTIONS

CROSS-REFERENCE TO RELATED APPLICATIONS

The present application is a continuation-in-part of U.S. patent application Ser. No. 15/953,914 filed Apr. 16, 2018, which in turn is a continuation of U.S. patent application Ser. No. 14/876,144 filed on Oct. 6, 2015 and now U.S. Pat. No. 10,006,126, which in turn claims priority to U.S. Provisional Patent Application No. 62/122,619 filed Oct. 27, 2014 and U.S. Provisional Patent Application No. 62/123,758 filed Nov. 28, 2014 and U.S. Provisional Patent Application No. 62/177,994 filed Mar. 30, 2015 and the contents of each of which are incorporated herein by reference.

BACKGROUND OF THE INVENTION

Numerous varieties of plating technologies are known in the art. These technologies include electrolytic plating which is also known as electro-plating and by other terms, and electroless plating also known as chemical, autocatalytic and by other terms.

Electroless plating is a well known and established commercial/industrial process for metal plating. The metal portion of the metal salt may be selected from suitable metals capable of being deposited through electroless plating. Such metals include, without limitation, nickel, cobalt, copper, gold, palladium, iron, other transition metals, and mixtures thereof, and any of the metals deposited by the autocatalytic process described in Pearlstein, F., "Modern Electroplating", Chapter 31, 3rd Ed., John Wiley & Sons, Inc. (1974), which is incorporated herein by reference. Generally, the electroless metal in the deposited coating is a metal, a metal alloy, a combination of metals, or a combination of metals and non-metals. Such coatings are often in the form of a metal, a metal and phosphorous, or a metal and boron. The metal or metal alloy is derived from the metal salt or metal salts used in the bath. Examples of the metal or metal alloy are nickel, nickel-phosphorous alloys, nickel-boron alloys, cobalt, cobalt-phosphorous alloys, and copper alloys. Other materials such as lead, cadmium, bismuth, antimony, thallium, copper, tin, and others can be deposited to form the bath and included in the coating.

The salt component of the metal salt may be any salt compound that aids and allows the dissolution of the metal portion in the bath solution. Such salts may include without limitation, sulfates, chlorides, acetates, phosphates, carbonates, and sulfamates, among others.

The reducing agents are electron donors. When reacted with the free floating metal ions in the bath solution, the electroless reducing agents reduce the metal ions, which are electron acceptors, to metal for deposition onto the article. The use of a reducing agent avoids the need to employ a current, as required in conventional electroplating. Common reducing agents are sodium hypophosphite, sodium borohydride, n-dimethylamine borane (DMAB), n-diethylamine borane (DEAB), formaldehyde, and hydrazine.

Certain materials may be used in electroless plating baths where these materials serve two or more roles in the plating bath. For example, instead of using the typical combination of nickel sulfate as a metal salt and sodium hypophosphite as a reducing agent, it is possible to use nickel-hypophosphite in an electroless nickel plating bath. Nickel-hypophosphite, however, is very expensive and not widely used commercially due to its impractical cost.

Electroless composite technology is a more recent development as compared to electrolytic composite technology. The fundamentals of composite electroless plating are documented in a text entitled "Electroless Plating Fundamentals and Applications," edited by G. Mallory and J. B. Hajdu, Chapter 11, published by American Electroplaters and Surface Finishers Society (1990).

BRIEF DESCRIPTION OF THE PRESENT INVENTION

The present invention is directed to a single solution useful for the make up and replenishment of a plating bath that is useful and economical on a commercial basis, as well as to its use.

The present invention is further directed to a family of compositions for electroless plating baths, the baths themselves, their use, and the resultant plated articles, wherein each of the compositions are usable as both an initial ("make up") composition for bath formulation as well as a composition for replenishment.

A functional benefit of the present invention includes cost and efficiency savings resulting from use of a single composition for bath initiation and replenishment.

BRIEF DESCRIPTION OF THE FIGURES

FIGS. 1A-1E include a chart (Chart 1) showing various combinations of components and their concentrations and operating ranges in single solutions of the present invention.

DETAILED DESCRIPTION OF THE PRESENT INVENTION

The present invention is directed to a single solution and its use for both make up and replenishment of an electroless plating bath, thereby replacing the two, three or four solution systems traditionally used in the field, generally customized at the time of replenishment based on bath characteristics. Auxiliary solutions may still be used with the single solution of the present invention, similarly to how they may be used in the prior art systems with two, three, four, or more solutions.

The present invention is also directed to a bath using the aforementioned solution as well as plated articles plated using the aforementioned solution.

In at least some embodiments the single solution can be a concentrate to which other contents can later be added for formulating a bath. In one example, the concentrate can be limited to at least one complexer, at least one pH adjuster and at least one stabilizer. Contents to be added to the concentrate to form a bath could be selected from the group comprising water, at least one metal salt, at least one reducing agent, at least one type of particulate matter, at least one particulate matter stabilizer, a brightener, a buffer, and an accelerator.

An objective of the present invention is to create a formulation as a single solution in defined concentrations which itself is usable as a make up and as a replenishment solution.

Though the present invention primarily focuses on some electroless nickel phosphorus plating systems, other plating systems fall within the spirit of this invention. Other examples include, but are not limited to:

All electroless plating baths

All electroless nickel plating baths

All nickel-phosphorous alloy ratios

Electroless nickel-boron
Poly alloys
Electroless cobalt
EN systems with different levels of brightness
EN plating that is subsequently blackened
Non-metal stabilized plating systems
Metal stabilized plating systems
Heavy metal stabilized plating systems
Composite plating systems
Electroless copper, palladium, gold, and/or silver
Alloys/combinations thereof The present invention includes embodiments directed to similar practices and solutions used for electroless nickel phosphorous, nickel boron, nickel boron phosphorous, nickel tungsten phosphorous, cobalt boron, cobalt phosphorous, copper phosphorous, and other plating baths.

The solution of the present invention may contain some quantity of one or more of the materials that are ordinarily added to the plating bath as auxiliary solutions. For example, it is within the scope of the present invention to have a single solution used for the make up and replenishment of the plating bath where this solution contains insoluble particulate matter, and additional quantities of particulate matter may be added to the plating bath during make up and/or replenishment as an auxiliary material or dispersion.

Although the present invention may include components for stability, brightness, fume control, pit reduction, or other alterations to the properties of the coatings, in some situations, platers may add additional auxiliary solutions to the plating bath for modified stability, brightness, fume control, pit reduction, or other alterations to the properties of the coatings resulting from the plating baths.

Electroless nickel (EN) is one of the most commercialized varieties of electroless plating. It is an alloy of nominally 86-99% nickel and the balance with phosphorous, boron, or a few other possible elements. Electroless nickel is commonly produced in one of four alloy ranges: low (1-5% P), medium (6-9% P), or high (10-14% P) phosphorous, and electroless nickel-boron with 0.5-5% B. Each variety of electroless nickel thus provides properties with varying degrees of hardness, corrosion resistance, magnetism, solderability, brightness, internal stress, lubricity, and other properties. All varieties of electroless nickel can be applied to numerous articles, including metals, alloys, and nonconductors.

The percent phosphorous in an EN alloy can be determined by a variety of methods such as but not limited to x-ray fluorescence, wet chemical methods, and scanning electron microscopic examination. A common practice to evaluate the corrosion resistance of an EN coating which is related to the percent phosphorous in the EN alloy is to subject an EN alloy to one or more of the following tests:

Immersion in nitric acid for a controlled period of time to see if any visual discoloration of the EN alloy results.

Immersion in a chamber containing a salt spray atmosphere until rust appears on the EN plated samples. Immersion in a ferroxyl solution to demonstrate the existence of pitting or porosity in the EN coating which can facilitate corrosion.

Avoiding such pits, porosity and other irregularities is important for many EN applications.

The plating of articles with a composite coating bearing finely dispersed divided particulate matter is well documented. The inclusion of finely divided particulate matter within metallic matrices can significantly alter the properties of the coating with respect to properties such as wear resistance, lubricity, friction, thermal transfer, and appearance.

The co-deposition of particles in composite electroless plating can dramatically enhance existing characteristics and even add entirely new properties. These capabilities have made composite electroless coatings advantageous for a variety of reasons including, but not limited to, increased utility in conditions requiring less wear, lower friction, lubrication, indication, authentication, thermal transfer, insulation, higher friction, and others. Composite electroless coatings with nickel provide an additional environmental advantage over conventional electroless nickel coatings, which do not include particulate matter, in that the particles within composite electroless nickel coatings reduce the amount of nickel alloy used. Such nickel based composite coatings are also an alternative to chromium based coatings which pose certain health and environmental challenges.

Particulate matter suitable for practical composite electroless plating may be from nanometers up to approximately 75 microns in size. The specific preferred size range depends on the application involved.

The particulate matter may be selected from a wide variety of distinct matter, such as but not limited to ceramics, glass, talcum, plastics, diamond (polycrystalline or monocrystalline types, natural or manmade by a variety of processes), graphite, graphene, oxides, silicides, carbonate, carbides, sulfides, phosphate, boride, silicates, oxylates, nitrides, fluorides of various metals, as well as metal or alloys of boron, tantalum, stainless steel, molybdenum, vanadium, zirconium, titanium, tungsten, as well as polytetrafluoroethylene (PTFE), silicon carbide, boron nitride (BN), aluminum oxide, graphite fluoride, tungsten carbide, talc, molybdenum disulfide (MoS), boron carbide and graphite. The boron nitride (BN), without limitation, may be hexagonal or cubic in orientation.

For increased friction on the surface of a resultant coating and/or increased wear resistance, hard particulates, such as but not limited to diamond, carbides, oxides, graphene, and ceramics, may be included in the plating bath. Application of an overcoat of a conventional plated layer on top of the composite plated layer is also done in the field in order to further embed the particulate matter within the coating.

For increased lubrication or reduction in friction in the resultant coating, "lubricating particles," such as polytetrafluoroethylene (PTFE), boron nitride (BN), talc, molybdenum disulfide (MoS), graphite or graphite fluoride among others may be included in the plating bath. These lubricating particles may embody a low coefficient of friction, dry lubrication, improved release properties, and/or repellency of contaminants such as water and oil.

For light emitting properties in the resultant coating, particulates with phosphorescent properties such as, but not limited to, calcium tungstate may be included in the plating bath.

For identification, authentication, and tracking properties in the resultant coating, various particulate and solid materials may be included in the plating bath so they will be incorporated into the coating and detectable either visually, under magnified viewing, or detection with a suitable detector.

The inclusion of insoluble particulate matter in composite electroless baths introduces additional instability. To overcome the extra instability due to the addition of insoluble particulate matter to the bath, such as described in U.S. Pat. No. 6,306,466, the general use of particulate matter stabilizers (PMSs) is believed to isolate the finely divided particulate matter, thereby maintaining the particular matter's "inertness". Such PMSs are well-known, and include, without limitation, sodium salts of polymerized alkyl naphthalene sulfonic acids, disodium mono ester succinate (anionic and nonionic groups), fluorinated alkyl polyoxyethylene ethanols, tallow trimethyl ammonium chloride, and any of the PMS disclosed in U.S. Pat. No. 6,306,466, which is incorporated herein by reference.

The electroless metallizing bath may also contain one or more complexers, also known as complexing agents. A complexing agent acts as a buffer for reasons which may include pH control and maintaining control over the "free" metal salt ions in the solution, all of which aids in sustaining a proper balance in the bath solution.

The electroless metallizing bath may further contain a pH adjuster to also help control pH levels in the bath. Suitable pH adjusters may buffer the plating bath at a desired pH range.

Some materials may serve one or more functions within an electroless plating bath. For example, ammonium hydroxide is both a pH adjuster as well as a complexer; cadmium, aluminum, copper and others materials are both a stabilizer and a brightener, lactic acid is both a complexer and a brightener, some sulfur compounds like thiourea are both stabilizers and accelerators depending on concentration, and there are other multipurpose ingredients useful in electroless plating baths.

Ingredients typical in electroless plating and useful in the present invention include, but are not limited to the following materials in the following general categories:

Complexers

Acetic Acid, Alanine-beta, Aminoacetic Acid, Ammonium Bicarbonate, Ammonium Carbonate, Ammonium Chloride, Ammonium Hydroxide, Boric Acid, Citric Acid, Citrates, EDTA, Ethylenediamine, Fluoboric Acid, Glycerine, Glycine, Glycolic Acid, Glycolic Acid Salts, Hydroxyacetic Acid, Lactic Acid, Maleic Anhydride, Malic Acid, Malonic Acid, Orthoboric Acid, Oxalic Acid, Oxalic Acid Salts, Propionic Acid, Sodium Acetate, Sodium Glucoheptonate, Sodium Hydroxyacetate, Sodium Isethionate, Sodium or Potassium Pyrophosphate, Sodium Tetraborate, Succinic Acid, Succinate Salts, Sulfamic Acid, Tartaric Acid, Triethanolamine, Monocarboxylic Acids, Dicarboxylic Acids, Hydrocarboxylic Acids, Alkanolamines, and combinations and variations of such materials.

Stabilizers

2 Amino-Thiazole, Antimony, Arsenic, Bismuth Compounds, Cadmium Compounds, Lead Compounds, Heavy Metal Compounds, Iodobenzoic Acid, Manganese Compounds, Mercury Compounds, Molybdenum Compounds, Potassium Iodide, Sodium Isethionate, Sodium Thiocyanate, Sulfur Compounds, Sulfur Containing Aliphatic Carbonic Acids, Acetylenic Compounds, Aromatic Sulfides, Thiophenes, Thionaphthalenes, Thioarols, Thiodipropionic Acid, Thiodisuccinic Acid, Tin Compounds, Thallium Sulfate, Thiodiglycolic Acid, Thiosalicylic Acid, Thiourea, and combinations and variations of such materials.

Brighteners

Aluminum, Antimony Compounds, Cadmium Compounds, Copper, Lactic Acid, and combinations and variations of such materials.

pH Controllers

Ammonium Bicarbonate, Ammonium Carbonate, Ammonium Chloride, Ammonium Hydroxide, Potassium Carbonate, Potassium Hydroxide, Sodium Hydroxide, Sulfamic Acid, Sulfuric Acid, and combinations and variations of such materials.

Particulate Matter Stabilizers (Dispersants, Surfactants, Wetters)

Sodium salts of polymerized alkyl naphthalene, disodium mono ester succinate (anionic and nonionic groups), fluorinated alkyl polyoxyethylene ethanols, tallow trimethyl ammonium chloridesulfonic acids, disodium mono ester succinate (anionic and nonionic groups), fluorinated alkyl polyoxyethylene ethanols, tallow trimethyl ammonium chloride, and any of the PMS disclosed in U.S. Pat. No. 6,306,466, which is incorporated herein by reference, and combinations and variations of such materials. Certain materials, including but not limited to these types of PMS materials are also useful in plating as anti-pit or pitch reducing agents. In this function, the materials are included in a plating bath to help produce coatings with less pits and/or other such irregularities which can form during the plating process.

Buffers

Borax, Boric Acid, Orthoboric Acid, Succinate Salts, and combinations and variations of such materials.

Reducing Agents

DMAB, DEAB, Hydrazine, Sodium Borohydride, Sodium Hypophosphite, and combinations and variations of such materials.

Accelerators

Fluoboric Acid, Lactic Acid, Sodium Fluoride, Anions of some mono and di carboxylic acids, fluorides, borates, and combinations and variations of such materials.

Metal Salts

Cobalt Sulfate, Copper Sulfate, Nickel Sulfate, Nickel Chloride, Nickel Sulfamate, Nickel Acetate, Nickel Citrate, and combinations and variations of such materials.

Historically electroless nickel and composite electroless plating processes have included heavy and/or toxic metals in the plating bath to overcome the inherent instability of the plating bath. Lead has been the most commonly used material to serve this purpose. Cadmium has also been used widely over the years as a brightener for electroless nickel coatings. But this incorporation of heavy metals into the plating baths presents multiple challenges. The heavy metals must be added in a sufficient amount to prevent the decomposition of the plating bath, but an increased concentration beyond the necessary level required to prevent the decomposition results in cessation or reduction of the plating rate. Increasingly stringent rules and regulations that restrict or prohibit the use of heavy metals, such as the Removal of Hazardous Substances (RoHS) and End-Of-Life Vehicle (ELV) Regulations. However, U.S. Pat. Nos. 7,744,685 and 8,147,601 disclose stable composite electroless nickel plating baths without the use of heavy and/or toxic metals. These patents are included herein by reference.

The electroless nickel and composite electroless nickel solutions of the present invention may contain heavy metals or may be essentially free of heavy metals, which means that no such heavy metal is added to the plating bath and/or the heavy metal concentration should be no more than a level that would cause the coating on articles plated in said bath to have a heavy metal concentration in excess of any relevant regulations. The solutions of the present invention may also contain heavy metals less toxic and/or subject to fewer regulations than lead, cadmium and others.

In recent years, there has been a growing desire within the plating industry to avoid the use of ammonium hydroxide. Ammonium hydroxide is an effective complexing agent and pH adjuster. Ammonium hydroxide, however, is objectionable to some plating shops due to environmental, health and/or safety regulations, smell, and the difficulty it causes in the ability to remove the nickel from the plating bath at the end of the bath's life because it is such a strong complexing agent. Storage and handling of ammonium hydroxide is also problematic as it can cause storage drums and other containers to bloat, it emits a very noxious odor experienced when opening a container, pumping, and transporting ammonium hydroxide, and causes a strong reaction when added to a hot plating bath unless the extra step of diluting the ammonium hydroxide by 50 percent by volume or more is performed in advance. Specially designed respirators are needed when handling ammonium hydroxide. It is therefore desirable to have a solution for an electroless nickel plating bath where this solution is free of ammonium hydroxide, and whereby the user or plater has the ability to use a material other than ammonium hydroxide as an auxiliary solution to maintain the pH of the plating bath during usage. The present invention is able to operate effectively with or without ammonium hydroxide. The present invention is able to operate effectively with sodium hydroxide, potassium hydroxide, potassium carbonate, and the like as pH adjusters within the solution of the present invention or as auxiliary additives to affect the pH of the plating bath made with the solution of the present invention. A feature that is typically valued by users of plating solutions is for the plating solution to be able to maintain the desired pH level of the plating bath with little to no auxiliary additions of pH adjusters such as those disclosed in the present invention. This feature is accomplished by the formulation of the plating solution to have a pH level and/or the sufficient concentration of ingredients to return the pH of the plating bath to the desired level by the routine additions of the plating solution required to maintain the desired level of the metal salt and/or reducing agent. Plating solutions with this feature are not only more convenient for the end-user, but also generally lead to a more consistent operation of the plating bath and/or more consistent quality of the coating produced by the plating bath. A solution that is formulated to maintain the pH of the plating bath as described herein is useful for many varieties of plating baths in the present invention, including, but not limited to electroless nickel and composite electroless nickel coatings with particulate matter incorporated in the coating.

In recent years, there has been a growing desire within the plating industry to use lower concentrations of metal salts in the plating baths. The primary justifications for this alternative to the conventional concentrations of metal salts in the plating baths are to 1) reduce the drag out of the metal salts from the plating baths to the subsequent rinse tanks and thereby reduce the amount of metal salts that need to be captured in subsequent waste treatment of the rinse water facilitating better environmental practices, 2) reduce the amount of metal salts that are essentially wasted when the plating bath comes to the end of its useful life and the bath is waste treated or otherwise disposed of, and 3) improve the quality of the plating by lowering the amount of metal salts in the bath which have the potential to precipitate or react in the bath in ways other than the desired reduction and deposition onto articles immersed in the plating bath for the purpose of plating, especially effective in reducing shelf roughness, 4) lowering the cost to make up a plating bath, 5) extend plating bath life, especially when plating onto aluminum substrates, 6) increase reducing agent efficiency, and 7) contain less metal and other substances in the mist emanating from the plating bath. An example of this practice is in the electroless nickel plating field where some platers are using plating baths with less than the traditional 6 grams per liter of nickel metal in the bath, for example, 3 grams per liter. The background and justification for using electroless nickel plating baths with a reduced nickel content is well documented in: www.pfonline.com/articles/fifth-generation-reduced-ion-electroless-nickel-systems. When applied to electroless nickel plating systems, the present invention is able to operate effectively at a traditional concentration of 6 grams per liter of nickel metal in the plating bath, 3 grams per liter of nickel metal in the plating bath, and other concentrations. Formulation of the solution useful for make up and replenishment of an electroless nickel plating bath according to the present invention, but using less than the amount of a metal salt required to yield the traditional 6 grams per liter of nickel metal in the plating bath, has the benefit of reducing the quantity of ingredients in the solution and thereby making the solution easier to formulate and concentrate.

In addition, in recent years, health and environmental concerns have been raised about the inclusion of certain materials such as perfluorooctane sulfonate (PFOS) and perfluorooctanoic acid (PFOA) that may be used in plating systems including composite plating systems, including those with PTFE. PFOS may be contained in certain particulate matter stabilizers (PMSs) useful for electroless plating. The present invention therefore includes compositions, baths, and methods for plating that may contain PFOA and/or PFOS, or may be free, or have only trace amounts of PFOA and/or PFOS.

While many elements of the EN plating chemistry, process, and industry have evolved, one essential aspect of the technology has remained relatively unchanged since the early style baths were surpassed by formulations that were easier and more reliable to operate. This aspect is the method to make up and maintain the EN plating bath. Make up of an EN bath involves combining the ingredients required to create a bath that is ready to be used for its intended purpose. Maintenance or replenishment of the EN bath involves replacing the chemical elements of the bath that have been depleted from the bath as plating occurs from the bath onto articles immersed in the bath.

While it is possible to make up and replenish a plating bath by adding the desired amount of each individual ingredient to form a solution, the established method to make up and replenish a plating bath is to combine three or more separate pre-made solutions with water.

When three solutions are used, it is common in the field to make up an EN bath with an "A" solution and a "B" solution and water. The A solution typically contains the metal salt (for example, nickel sulfate), may contain other ingredients, and accounts for five to six percent of the volume of the plating bath. The B solution typically contains the reducing agent (for example, sodium hypophosphite), other functional ingredients like stabilizers, brighteners, pH buffers, chelators, complexing agents, accelerators, particulate matter stabilizers, etc., and accounts for fifteen to twenty percent of the volume of the plating bath. The balance, typically about eighty percent of the volume of the plating bath, is made up of water plus the possibility of an acid or base to adjust the pH of the EN bath before it is heated to the desired temperature and used for plating. The water is typically deionized water. That is, the initial bath is comprised of the A solution, the B solution, water, and potentially a pH adjuster, where the pH adjuster may be introduced into the water before being combined with A and B.

The use of multiple plating compositions as described herein, is referred to as a "plating bath system".

As the bath is used, it needs to be replenished. The EN bath is then typically replenished with the A solution as well as a "C" solution. The C solution is typically similar to the B solution, containing the reducing agent (for example, sodium hypophosphite), other functional ingredients like stabilizers, brighteners, pH buffers, chelators, complexing agents, accelerators, particulate matter stabilizers, etc., but the specific combination and concentration of these materials are in different concentrations in the C solution than they are in the B solution. The reason for the difference of concentrations of these materials is the difference in the consumption or depletion rate of each material from the initial make up concentration due to the plating reaction. The C solutions are typically formulated to be used in a convenient ratio to the A solutions, for example one part A solution plus two parts C solution; or for example one part A solution plus one part C solution.

When more than two solutions are used, such as the Addplate® concentrate systems sold by Surface Technology, Inc. of Ewing, N.J., it is common in the field to make up an EN bath with three solutions such as 1) an "M" solution, 2) a solution of nickel sulfate, and 3) a solution of sodium hypophosphite, plus water. The M solution typically contains the functional ingredients like stabilizers, brighteners, pH buffers, chelators, complexing agents, accelerators, particulate matter stabilizers, etc., and accounts for eight to ten percent of the volume of the plating bath. The nickel sulfate and sodium hypophosphite solutions typically account for four and a half percent each of the volume of the plating bath. The balance, typically about eighty-two percent of the volume of the plating bath, is made up of water plus the possibility of an acid or base to adjust the pH of the EN bath before it is heated to the desired temperature and used for plating. The water is typically deionized water. The EN bath is then typically replenished with an "R" solution as well as the nickel sulfate and sodium hypophosphite solutions. The R solution is typically similar to the M solution, containing the functional ingredients like stabilizers, brighteners, pH buffers, chelators, complexing agents, accelerators, particulate matter stabilizers, etc., but the specific combination and concentrations of these materials are in different concentrations in the R solution than they are in the M solution. The reason for the difference of concentrations of these materials is due to the difference in the consumption or depletion rate of each material from the plating bath during usage of the plating bath and the plating reaction. The R solutions are formulated to be used in a convenient ratio to the nickel sulfate and sodium hypophosphite solutions, for example one part nickel sulfate solution plus one part sodium hypophosphite solution plus one part R solution; or for example one part nickel sulfate solution plus one part sodium hypophosphite solution plus one half or one third part R solution.

Some companies in the plating industry have offered and/or used systems where the bath can be made up of one single component instead of two, three or more. But in none of these systems is it possible to replenish that same bath with the same make up solution for ongoing maintenance of the bath over the bath's life while providing proper bath stability and plating quality.

It is possible, especially as would be evident to one skilled in the art from understanding the present invention, to operate an electroless plating bath with one component used alone to make up the plating bath and a second component used alone to replenish the plating bath. Such a two component system still lacks the full utility of the single component of the present invention.

One object of the present invention is to provide a single solution (or "concentrate") that may be used in both the makeup (initial) and the replenishment of a plating bath, where this single component contains functional ingredients such as one or more complexing agents, pH adjusters, and stabilizers, but is not the primary source of the metal salt and/or reducing agent. Such a single component could be used in either one of two ways. First, such a single component could be mixed with a metal salt and/or reducing agent and/or water to form a solution that is usable for both the makeup and replenishment of a plating bath as described in the present invention. Second, such a single component could be used for both the makeup and replenishment of a plating bath where a metal salt and/or reducing agent is added to a plating bath as separate components, but in conjunction with the addition of the single component. The utility of such a single component, or concentrate, is that it could be more advantageous in the manufacturing, shipping, and storage as the volume of the concentrate would be lower. In addition, such a single component, if it were free of a metal salt may be easier and/or more economical for transportation if it is in a different shipping or hazard class than a similar solution containing a metal salt. Further, such a single component could be more economical to a manufacturer, distributor, or end-user of the single component as the distributor, end-user, or others could add the metal salt and/or reducing agent which may be readily available chemicals as opposed to obtaining these already mixed into a complete solution.

When discussing the materials and solutions used in the make up and replenishment of electroless plating baths, and if the system is a one, two, three, four or more solution system, it is customary in the field to count the number of solutions containing the primary functional ingredients such as metal salts, reducing agents like stabilizers, brighteners, pH buffers, chelators, complexing agents, accelerators, particulate matter stabilizers, etc., and mixtures thereof. The addition of any other ingredients to the plating bath is not considered an additional solution. For example, the addition of materials such as ammonium hydroxide, other hydroxides, carbonates and the like to adjust the pH of the plating bath are not considered a solution in the same way as a typical A, B, C, M or R solution is counted in the system. These materials are considered auxiliary solutions. Solutions of additional stabilizers, brighteners, accelerators, PMSs, and other materials may also be used as auxiliary solutions to modify the plating bath for specific purposes, often for episodic purposes rather than consistent uses. If such materials were needed for consistent, routine purposes in the plating bath, they might be incorporated into one or more of the primary solutions such as the A, B, C, M or R solutions. Similarly, the addition of particulate matter, in powder, liquid dispersion, or other form, is also considered an auxiliary material or solution, and is not considered a solution or component in the same way as a typical A, B, C, M or R solution is considered as a solution in the system.

Consequently, it would be beneficial for a single solution usable for both initial and replenishment purposes.

These and other objectives of the present invention together with the advantages over the existing prior art and method will become apparent from the following specification and the method described herein.

The present invention is directed to processes and product related to a single solution for both the make-up and replenishment of an electroless plating bath.

In describing the preferred embodiments of the present invention, specific terminology will be resorted to for the sake of clarity. However, the invention is not intended to be limited to the specific terms so selected, and is to be understood that each specific term includes all technical equivalence which operate in a similar manner to accomplish a similar purpose.

The typical operation of an electroless plating bath consists of the following steps. First, a plating bath is made up traditionally as already discussed in this disclosure. The plating bath is then heated by any of a number of mechanisms to reach a desired operating temperature. Articles for plating are then cleaned and otherwise pretreated according to their base metal(s) and condition, and immersed into the plating bath. While the articles are being plated for a time commensurate with the plating rate of the plating bath and the desired thickness of the plating onto the articles, the temperature and pH of the plating bath are typically monitored and maintained at desired levels. During or after the plating of the articles, the plating bath is analyzed to determine the amount of certain components in the plating bath. Typically this analysis is only for the metal of the metal salt in the plating bath, and this is accomplished by wet chemistry or by instrumental analysis. Based on the concentration of this metal in the plating bath, the plating bath is traditionally replenished with two or more solutions containing the ingredients needed to replace what has been depleted onto the articles. This replenishment can be added to the plating bath by pouring, pumping, or other means. Analysis of other components such as reducing agents and stabilizers in the plating bath can be accomplished, but is much less common, and therefore increases the potential for the ratio of ingredients to become imbalanced with the metal salt and other ingredients in the plating bath. This represents one further advantage of the present invention whereby the ingredients will remain in the proper ratio as they are all contained in the single primary component used for make up and replenishment of the plating bath.

Typically the plater (the end user of the plating bath) buys the solutions needed to make up and replenish the plating baths from a supplier (a manufacturer or distributor) of such solutions.

There are numerous shortcomings to this decades old practice on how to make up and replenish and use electroless plating baths.

First, the need to use multiple solutions for bath make up and replenishment involves significant logistics, including shipping, storage, labeling, material safety data sheets (MSDS) and other product information. These excessive logistics add complexity to both the manufacturer of the solutions, any distributors that may be involved, transportation companies, compliance companies, emergency response organizations, and naturally the end user of the solutions.

Second, the use of multiple solutions requires the packaging and shipping of excess deionized water. This causes excessive packaging materials such as totes, drums, buckets, etc. It also causes excess shipping of water that means higher costs to the manufacturer and end user, as well as a waste of energy by the transport company.

Third, the use of multiple solutions increases the opportunity for error by the end user. There exists the opportunity, as is known to occur periodically, for an end user to mistakenly use a "C" solution during bath make up instead of the correct "B" solution, or mistakenly use a "B" solution for replenishment of a bath instead of the correct "C" solution. When these mistakes occur, made more likely by the presence of multiple solutions, the composition of the bath will certainly be out of balance, and there is a strong likelihood that the bath will be rendered useless for proper plating.

Fourth, even though the manufacturers of solutions to be used by platers formulate their solutions to work in relatively convenient formulations so they can be used in a certain ratio, these practices and the formulations still have shortcomings. A typical plating system may use A, B, and C solutions whereby the bath is made up with 5% by volume of the A solution plus 15% by volume of the B solution plus water as the balance. Such baths are then typically replenished during use with a ratio of 1 part of the A solution to 2 parts of the C solution. This means that one metal turnover (MTO) would involve the cumulative addition of another 5% by volume of the A solution plus 10% by volume of the C solution. The shortcoming of this system is that while the solutions are formulated for use in this or another designated ratio, in practice, it is difficult for many platers to accurately make the required additions of the multiple solutions so as to assure proper ratios and pH. Use of improper ratios or pH can impact the coverage of the article being plated as well as have other non-desirous consequences. Through manual pouring/measuring of the individual solutions and adding each to the bath, there are numerous opportunities for the user to add the wrong amount of one or more of these solutions and thereby cause the ingredients in the plating bath to become out of balance, which can lead to one or more of the problems in the plating bath, and/or the plating disclosed in the course of this present invention, and/or possibly, the need to dispose of the bath unnecessarily prematurely. While some platers use automated pumping systems to make the additions of the replenishment solutions, and some include automated analysis equipment to determine the quantities of replenishment solutions required, malfunctions and other issues can occur which can lead to the wrong amount of one or more of these solutions being added to the plating bath and thereby cause the ingredients in the plating bath to become out of balance.

Fifth, when using multiple solutions for the make up and/or replenishment of a plating bath, there exists an opportunity for contamination of one solution to the next if pumps, containers, and the like are shared between two or more of the solutions.

There exists, therefore, an unmet need for a novel electroless plating bath formulation and system of make up and replenishment.

The present invention meets this need with a novel single solution that is useful for both plating bath make up as well as replenishment.

It is further an object of the present invention that a single solution can be useful for both the makeup as well is replenishment of not just one type of plating bath, but multiple types of plating baths. For example, a single solution that can be mixed with water to produce and replenish a plating bath that produces an electroless nickel coating where the same single solution can be used to produce and replenish our electroless nickel coating containing one or more different types of particulate matter; including the possibility that the particular matter is added through an auxiliary solution. Thus the single solution not only replaces, for example, three solutions such as a typical A, B, and C, solutions; but a single solution that replaces multiple A, B, and C solutions.

As will become evident in the examples below, the present invention includes multiple combinations of ingredients in various ranges of quantities/percentages in a single solution useful to both make up and maintain the composition of ingredients in the plating bath. In general, the present invention is comprised of a family of solutions each of which affords an improved ease of use with less room for error and may also extends the life of typical plating baths.

The present invention solves the aforementioned deficiencies and other deficiencies in conventional electroless plating bath systems by overcoming a number of factors which have limited manufacturers and users of plating baths to use plating bath systems with multiple solutions instead of a single solution. These factors include, but are not limited to, the following:

1. Keeping the metal salt(s) and reducing agent(s) in separate solutions to avoid any possible reaction between these ingredients before they are introduced to the plating bath. Because this may still be beneficial, at least in part for other reasons (such as but not limited to transport costs), one embodiment of the present invention is a concentrate to which the metal salt and/or reducing agent may be added.

2. Keeping all ingredients stable and free from precipitation while in solution. If a material precipitates out of a solution, it will not get properly added to the plating bath and therefore cause performance problems at least at certain pH levels. Replenishment solutions (like a typical C solution) generally have a pH that is higher than the pH of a solution containing metal salts in high concentrations such as a typical A solution or the single solution of the present invention. The pH level of a solution also affects the ability of the solution to maintain the desired pH level of the plating bath.

3. The usage ratios of different ingredients are ordinarily different in make up and replenishment. When making an electroless plating bath, certain ingredients are included in specified quantities required for the bath to work properly. As parts are plated in this bath, each of the bath ingredients is consumed at different rates. Some ingredients are consumed faster, some slower, and some essentially not at all. It is for this reason that the C solution typically has different concentrations of ingredients than the corresponding B solution used to make up the plating bath. In addition, it is possible to have some ingredients in a C solution that are not in the corresponding B solution that can improve the performance of the plating bath as it is used.

4. Proper stabilizer content is critical for the performance of a plating bath. Achieving this content is especially challenging as these stabilizer ingredients (such as those listed in this disclosure, and others) are used in very small amounts relative to the other ingredients. Stabilizers are typically used in parts per million whereas other ingredients are used in grams per liter.

5. If any or all ingredients are not added and maintained in the proper concentrations in the plating bath, the resulting deficiencies can range from instability, overstability, precipitation, shortened bath life, and plating defects (including pits, nodules, edge problems, skip plating, streaks, inconsistent finish, deficient performance, and others).

A key measure of the quality and suitability of solutions for making up and replenishing electroless plating baths is the resulting plating rate and lifetime of the plating bath.

The plating rate represents the thickness of the coating achieved from a plating bath over a period of time. For example, microns of thickness per hour is a typical measure of plating rate. There are generally accepted ranges of plating rates for various types of plating baths and these rates might differ based on the articles being plated. For example, a typical low to medium phosphorous plating bath typically plates at a rate of 15 to 25 microns per hour. A typical high phosphorous electroless nickel plating bath plates at a rate of 7 to 12 microns per hour. The plating rate of a given plating bath depends upon operating temperature, bath loading, pH, agitation, age of the bath, and other factors.

A bath life is typically measured in "metal turn-overs" or MTOs. Different baths can have different MTO lifetimes depending on a number of factors such as but not limited to the type of plating bath, the operation and maintenance of the plating bath, the quantity and types of articles plated, the base metal of the articles being plated, and other factors. One MTO represents the use of a plating bath over a period of time where parts are plated, the cumulative quantity of the metal salt in the bath at make up is used (deposited onto parts immersed in the plating bath) and replenished into the plating bath. For example, if a one liter electroless nickel plating bath is made up with 6 grams of nickel metal (coming from a metal salt like nickel sulfate), parts are plated therein until 0.6 grams of nickel are depleted, the bath is replenished with 0.6 grams of nickel, and this process is repeated 9 more times for a total depletion and replenishment of 6 grams of nickel, then this bath has achieved one MTO. Of course it is not only the nickel salt that is consumed and replenished in the course of usage. Any and all reducing agent(s), stabilizer(s), brightener(s), etc. can be consumed, and all ingredients must be maintained in proper concentration in the plating bath, otherwise plating bath performance, life, and resulting plating quality will suffer. Adding too much or too little of certain ingredients can also reduce the bath life or result in undesired plating. Another factor influencing the bath life is the gradual build up of byproducts in the plating bath as a result of the plating reaction. A maximum bath life is important to the plater since the solutions used for plating baths are a significant cost to the plater; it is time consuming, inconvenient, and costly for the plater to dispose of a used bath and replace it with a new bath; treatment of a used bath is costly and can have environmental implications. Therefore it is important to the plater that the solutions used for bath make up and replenishment are formulated in a way as to maximize bath life and performance.

When evaluating solutions for the make up and replenishment of an electroless plating bath, achieving at least one MTO with proper performance and results is a significant threshold to validate the composition(s) of the solution(s). In commercial practice, the following are the typical numbers of MTOs that are anticipated. 8-12 MTOs for low phosphorous EN, medium phosphorous EN, EN composites with diamond, silicon carbide, boron nitride, ceramics, particles with identification properties, and the like. 4-7 MTO for high phosphorous EN before the resulting EN plating no longer provides the desired level of corrosion resistance. 2-3 MTO for EN composites with PTFE. Of course, the actual results depend on the manner in which the plating baths are maintained. The introduction of contaminants to the plating bath, improper maintenance of the plating bath, and other factors can reduce the life of the plating bath. In addition, the lifetime of the plating bath depends on what material articles are being plated. For example, plating baths used to plate onto aluminum articles typically will have a shorter life than plating baths used to plate onto steel articles because of the contamination of zinc into the plating bath, as zinc is inherent in the traditional pretreatment process for aluminum articles, which typically involves an immersion in a zincate solution and this zincate solution subsequently dissolves in part into the plating bath.

Although some plating bath systems exist for the perpetual use of the plating bath, accomplished by removal of byproducts from the bath and replenishment with select materials, such baths are generally not considered practical nor economical for widespread commercial use, and therefore the life of an electroless plating bath in terms of the number of MTOs achievable is an important factor in the utility of an electroless plating bath.

One example of such a perpetual, rejuvenation style (aka "regeneration") plating bath and system is in U.S. Pat. No. 5,609,767 to Eisenmann. In the present invention, as in any conventional replenishment type of plating bath and plating process, such as but not limited to an electroless nickel plating process, a plating bath is formed comprised of a collection of chemicals and metals together with water, and articles for plating are dipped into the bath and plated. Because of the chemistry involved, some of the original chemical and metal solution is consumed in the plating process onto the immersed articles, and byproducts are formed and remain in the bath. As a result, the chemical makeup of the bath changes consequential to the plating itself. Over time, the bath becomes unusable for plating. In general, the bath's life can progress until the byproducts become too excessive. As stated above, the measure of a plating bath's lifetime is typically stated in metal turnovers, MTOs or turnovers.

The present invention is further directed to a novel commercial process for plating and replenishing the associated plating bath, not bath regenerating, as in Eisenmann. In the process of the present invention, an initial solution is mixed with water to establish an initial plating bath. After a period of plating, the same initial solution is added to the plating bath so as to allow for continued plating. Only one solution is ever used. No second source of materials is added for replenishment as required in Eisenmann.

The present invention demonstrates that nothing but the initial (single) solution is disclosed or added for replenishment. That is, although the bath's chemical composition may be, and typically is, different from the original bath when the initial solution is reintroduced through replenishment, the plating is not adversely impacted.

Eisenmann is directed to a regeneration process, not a replenishment process, and also is not directed to nor does it disclose or even suggest a single solution usable as a starter solution and for replenishment. Eisenmann's goal is to treat a spent solution, not to replenish an existing bath.

Replenishing a bath requires adding additional chemicals to an already functioning bath to extend the life of the functioning bath. Typically replenishing may be achieved a large number of times before the bath needs to be discarded and the bath needs to be discarded when byproducts become excessive. Up to 200 replenishments to a bath used for a lifetime of ten metal turnovers is reasonable. Regeneration, sometimes called electrodialysis, is a process whereby a spent bath's content is extracted for treatment, and much of which the treated solution is returned, together with other added chemicals, so as to avoid dumping of waste. Additional examples include U.S. Pat. No. 7,968,149 and the July 1998 Publication from the United States Environmental Protection Agency on Extending Electroless Nickel Bath Life Using Electrodialysis, where the differences in the two processes are described. Lawrence Livermore National Laboratory also describes the difference in its April 1995 publication, "Electroless nickel recycling via electrodialysis". Similarly and article in the November-December 2002 publication, Metal Finishing, by David Crotty and Daniel Bailey, entitled Electridialysis of electroless nickel process solutions: Continuous versus batch treatment, desings," the distinction is explained.

In a 2005 paper by Peter Longfield, of the Aotech company, which is a leader in a rejuvenation system for electroless nickel baths, called EDEN, which is akin to the Eisenmann method involving electrodialysis and ion separation. As noted in the reference this method is not generally found in broad scale industrial use, at least in part, because it requires non-continuous production with the bath being taken out of service. The present invention is directed to replenishment, not regeneration.[BL1]

Eisenmann is directed to a regeneration process for treatment of a spent plating solution (see Col. 5, Ins. 30-31) and not at all to use of a single solution as the only solution for both starter and replenishment purposes. This is also stated in the Eisenmann Abstract. Eisenmann's initial solution, when added with other ingredients, is only compatible with a regeneration process (see Col. 2, Ins. 7-9). Eisenmann does not even suggest compatibility with a replenishment process and actually suggests it is not compatible with one. When Eisenmann regenerates his bath, he does so by adding starter solution in synchrony with treating the existing solution, extracting materials from the treatment, adding some, discarding some, and adding yet other materials not in the starter solution, plus adding an additional stabilizer. To be more precise, Eisenmann explicitly states that his invention is directed to a process improvement over the recovery process of U.S. Pat. No. 5,112,392, which discloses a process for removing byproducts and other counter-ions from a spent plating bath.

Regeneration and replenishment are not the same. A careful reading of Eisenmann shows he uses the word "replenishment" only as an adjective describing his solution. Simply put, he only uses the word to name his solution and not to suggest its applicability to a replenishment process. It is not the process he uses, which he consistently calls a regeneration process. Relative to processes, regeneration and replenishment are well known terms of art in the industry and differ from one another. Eisenmann's use of "replenishment" as an adjective for describing a solution for "regeneration" is common terminology in the industry. See, for example, U.S. Pat. No. 7,968,149 and July 1998 Publication from EPA on Extending Electroless Nickel Bath Life Using Electrodialysis (Electrodialysis is a synonym for Regeneration). The present application even makes this distinction between regeneration and replenishment clear.

Eisenmann also explains the difference between his regeneration process and replenishment. "Existing commercial EN baths typically reach end-of-life after the original nickel content has been replaced four times through replenishment . . . . Commercial baths are not suitable for the inventive regeneration scheme because (1) the presence of ammonium salts interferes with the precipitation of calcium compounds, precluding consistent, high-quality nickel plates, and (2) conventional EN baths depend on frequent or continuous replenishment for stable performance[BL2], which are incompatible with the regeneration scheme." Col. 2, Ins. 17-30. Eisenmann consequently avoids ammonium salts in his bath. See Col. 2, Ins. 59-61. Consequently, Eisenmann's bath is quite particular about its content to meet his purposes and goals.extended.

Moreover, Eisenmann's starter and replacement solutions cannot be the same. Eisenmann adds more than just the initial solution, and indeed removes matter as well. Eisenmann explicitly adds hypophosphite and thiourea as his "control". His use of the word "maintained" clearly means adding materials to the bath. Eisenmann notes the addition of stabilizer to the solution formed from the ion exchange process. The addition of stabilizer alone demonstrates differences between Eisenmann's start and replenishment solutions. Eisenmann explicitly states multiple times that the its result is to form a regeneration solution that is "essentially" (meaning not exactly the same) the starter solution, or to form a regenerated bath similar in make up, but not identical, to the original bath.

The present invention is not directed to returning a bath to its starter configuration. After some amount of plating, the bath's composition has been altered as some material has left the bath through plating and other byproducts not in the original bath remain behind. Further, on careful reading, it is clear that the Eisenmann process introduces a replacement solution highly distinguishable from his starter solution. The Eisenmann replacement solution is his starter solution plus a lot more and is only added in combination with materials derived from the ion exchange process. In one example, he adds thiourea in sizable, defined quantities. (Col. 6, Ins. 9-10; Col. 6, Ins. 31-33). So Eisenmann's replenishment solution, sourced in several sub-processes, actually differs substantially and fundamentally from his starter solution. He makes this distinction clear. (Col. 3, Ins. 31-36).

Eisenmann even points out that his process is inapplicable to commercial baths because of difficulty with "precipitation of calcium compounds" and "continuous replenishment is incompatible with his regeneration scheme". Col. 2, Ins. 23-30. In addition, the Eisenmann chemical composition is not consistent with the composition of a typical commercial bath because, as Eisenmann states, "Bath usage causes the concentrations of phosphite, acetate and sulfate to increase, and eventually to reach the point where nickel phosphite begins to precipitate. This is the case when about 15 g nickel has been plated per liter bath at a nickel concentration of 0.05 mole per liter and a pH of 5. More nickel can be plated at lower pH and lower nickel concentration." Col. 5, Ins. 13-20. This low level of resistance to nickel phosphite precipitation demonstrates that the chemical composition in Eisenmann is substantially lower (about four times) than that of the typical electroless nickel plating bath used with the common replenishment method. A commercial replenishment bath is formulated to strongly complex the nickel ions in the bath for proper performance and lifetime. In contrast, such strong complexing of nickel ions would make a commercial bath, such as a typical replenishment bath like the one in the present invention, incompatible with the Eisenmann process which relies on the nickel ions being relatively easily removed from the bath during his ion exchange process during regeneration. Similarly, a bath as formulated in the Eisenmann patent would not be suitable for commercial usage due to the propensity for nickel phosphite precipitation, which Eisenmann admits to.

When evaluating solutions for the make-up and replenishment of an electroless plating bath, verification of the physical properties of the coatings resulting from this plating bath is significant to validate the composition(s) of the solution(s). Such physical properties of the coatings include, but are not limited to, composition, hardness, corrosion resistance, thickness, uniformity, electrical conductivity and resistivity, porosity, appearance, brightness, reflectivity, adhesion, stress, elasticity, tensile strength, elongation, density, coefficient of thermal expansion, wear resistance, coefficient of friction, and/or other properties.

Ingredients typical in electroless plating and useful in the present invention include, but are not limited to:

Acetic Acid, Glacial
Ammonium Bicarbonate
Ammonium Carbonate
Ammonium Hydroxide, Reagent
Ammonium Hydroxide, Technical
Borax
Boric Acid
Caustic Potash
Caustic Soda
Caustic Soda Beads
Citric Acid
DMAB
Glycerine
Glycine
Hydroxyacetic Acid
Lactic Acid
Malic Acid
Nickel Sulfate Liquid
Nickel Sulfate Crystal
Propionic Acid
Sodium Glucoheptonate
Sodium Hypophosphite
Sodium Isothionate
Succinic Acid
Sulfamic Acid
Sulfuric Acid, Reagent
Tartaric Acid, NF Granular A solution is prepared using selected ingredients in defined concentrations and the solution is mixed with water to form a bath. Once the bath has been prepared, it is ready for use in the electroless plating process of the present invention. This involves contacting the surface of an article with the electroless metallizing bath. However, the article to be coated may require preliminary preparation prior to this contact in order to enable the autocatalytic plating deposition on the surface of the article. This preparation includes the removal of surface contaminants. For example, this process may involve any of, but not limited to, degreasing, alkaline cleaning, electrocleaning, zincating, water or solvent rinsing, acid activation, pickling, ultrasonic cleaning, physical modification of the surface, vapor or spray treatments, etc.

An electroless plating bath is typically operated according to the following practices related to the equipment, and operation of the bath.

The plating tank is typically constructed of polypropylene, stainless steel or mild steel with a suitable tank liner depending on bath in use and other considerations. Stainless steel tanks may be anodically protected. In laboratory testing and small scale plating, beakers made of Pyrex and the like are used, often on a hot plate with a magnetically driven PTFE coated stir bar at the bottom of the beaker.

Filtration of electroless plating baths through a 10-micron or finer rated polypropylene filter bag or wound cartridge system is common. The filtering pump system typically turns the bath over at a rate of at least 10 times per hour. The filtration method and rate are often different for composite electroless plating and determined according to the specific composite electroless plating bath system being used.

Agitation is useful in maintaining bath homogeneity and consistent finish. Air spargers with air from a high volume, low-pressure air blower is common. Compressed air is not recommended due to potential oil contamination. Other types of agitation, may also be used.

Heating of the bath may be accomplished by various methods including heat exchangers and immersion heaters. The bath temperature should be monitored and maintained closely. Cooling of the bath with an appropriate cooling apparatus should be done rapidly at the end of a shift or any time the bath will not be used for an extended period of time.

Rack, barrel, and fixturing devices to hold the parts, workpieces, or articles being coated in an electroless plating bath are typically constructed of compatible materials such as polypropylene, chlorinated polyvinyl chloride, stainless steel, PTFE, synthetic rubber/fluoropolymer elaster, silicone rubber, and other materials that can withstand the chemicals and temperature of the plating bath and pretreatment process. Maskants may be used to protect portions of fixtures and/or articles from being plated. Masking is typically accomplished with compatible materials such as certain vinyl tapes, stop-off paints, plugs and gaskets made of synthetic rubber/fluoropolymer elaster, silicone rubber, and others that can withstand the chemicals and temperature of the plating bath and pretreatment process.

The plating tank should be clean and passivated prior to use and periodically during use generally depending on usage rates and conditions. The most common method is with a solution of 40-50% nitric acid for 1-4 hours at room temperature, followed by rigorous rinsing and verification that no nitrate contamination remains.

The plating bath is typically maintained to be within 80% and 100% concentration of nickel, hypophosphite, stabilizers, and/or other chemicals based on the initial make up concentration of these ingredients. Tighter control further helps performance. Titration of the plating bath to ascertain the metal concentration in the plating bath is typically before and after every batch of parts that is plated. Replenishing is normally done during and/or between plating cycles. Analysis of the reducing agent concentration is typically performed much less frequently or not at all in commercial use of electroless plating baths. Testing is performed to determine concentration of one or more of the ingredients, so as to determine the need for replenishment. When making up and replenishing a plating bath with a solution from the present invention, the need to analyze for the reducing agent concentration in the bath will be even less necessary as the reducing agent and the metal salt will be continually added in proper ratio when they are contained in a solution from the present invention, and not added separately in two different solutions.

Continual and accurate measurement of bath temperature, pH, and bath solution volume level is important and typically done. Evaporation will reduce bath volume level and give false indication of actual concentration if this factor is not accounted for when analyzing the plating bath for the concentration of any ingredients. Adding water (typically deionized) as needed during the plating cycle is useful to keep solution at the proper level which is the volume level at which the plating bath was originally made up.

The plating baths made from the solution of the present invention are suitable for use according to the above generally accepted procedures and equipment, and no unique equipment or accommodations are anticipated for the use of the single solution of the present invention in comparison to the multiple solutions of the current practice in the field.

An electroless plating bath is typically operated generally according to the following practices related to the equipment, and operation of the bath.

- The plating tank is typically constructed of polypropylene, stainless steel (Type 316) or mild steel with a suitable tank liner depending on bath in use and other considerations. Stainless steel tanks may be anodically protected.
- Filtration through a 10-micron or finer rated polypropylene filter bag system is suggested. Polypropylene wound cartridge filters are also permissible, but are not as easy to use as filter bags. The filtering pump system should turn the bath over at a rate of at least 10 times per hour.
- Agitation is useful in maintaining bath homogeneity and consistent finish. Air spargers with air from a high volume, low-pressure air blower is recommended. Compressed air is not recommended due to potential oil contamination. Other types of agitation, may also be used.
- Heating of the bath may be accomplished by various methods including heat exchangers and immersion heaters. The bath temperature should be monitored and maintained closely.
- Cooling of the bath with an appropriate cooling apparatus should be done rapidly at the end of a shift or any time the bath will not be used for an extended period of time.
- Rack, barrel, and fixturing devices are typically constructed of compatible materials such as polypropylene, CPVC, stainless steel, PTFE, Viton, silicone rubber, and others that can withstand the chemicals and temperature of the plating bath and pretreatment process. Maskants may be used to protect fixtures from being plated.
- Masking is typically accomplished with compatible materials such as certain vinyl tapes, stop-off paints, plugs and gaskets made of Viton, silicone rubber, and others that can withstand the chemicals and temperature of the plating bath and pretreatment process.
- The plating tank should be clean and passivated. The most common method is with a solution of 40-50% nitric acid for 2-3 hours at room temperature, followed by rigorous rinsing and neutralizing of the tank and verification that no nitrate contamination remains.
- The plating bath is typically maintained to be within 80% and 100% concentration of nickel, hypophosphite, stabilizers, or other chemicals based on the initial make up concentration of these ingredients. Tighter control further helps performance.
- Titration of the plating bath is typically before and after every batch of parts that is plated. Replenishing is normally done during plating cycles if the workload will lower the nickel concentration to 90% or less.
- Continual and accurate measurement of bath temperature, pH, and bath solution level is important and typically done. Evaporation will reduce bath volume and give false indication of actual concentration. Adding distilled water (DI) as needed during the plating cycle is useful to keep solution at proper level.
- The deposition rate of a given plating bath depends upon operating temperature, bath loading, pH, agitation, age of the bath, and other factors.

In some situations, there might be a need to blacken a coating. The technique of blackening electroless nickel coatings is known in the industry. A number of methods have been developed to produce black electroless nickel. The most common process is generally characterized by the oxidation or etching of an electroless nickel coating. Oxidizing materials that can be used include acids, metal chlorides, peroxides and other oxidizing agents.

Another method involves adding materials to the electroless nickel plating bath similar to what can be used in black electrolytic nickel plating baths. Such ingredients may include zinc and/or sulfur. Such materials may be included in the solutions of the present invention.

The preferred embodiments of the present invention are detailed in the examples.

Though the present invention primarily focuses on some electroless plating systems other plating systems fall within the spirit of this invention. Other examples include, but are not limited to: all electroless plating baths, all electroless nickel plating baths including any content of phosphorous and/or boron, poly alloy plating baths, electroless cobalt plating baths, EN systems with different levels of brightness, EN plating that is subsequently blackened, plating systems stabilized with heavy metals, toxic, non heavy metals, non toxic metals, or no metals, plating baths including nickel hypophosphite, composite plating systems, electroless cobalt, copper, palladium, gold, and/or silver plating baths, plating baths that are made up with or without ammonium hydroxide, plating baths that may be replenished and maintained with or without ammonium hydroxide, plating baths that are made up with or without ammonium hydroxide, and plating baths that may be replenished and maintained with or without ammonium hydroxide.

The present invention encompasses all varieties of electroless nickel coatings with varying concentrations or freedom from various materials such as, but not limited to, lead, cadmium, heavy metals, toxic metals, PFOA, PFOS and others that are subject of environmental and related regulations such as Restriction of Hazardous Substance Directive (RoHS), Directive on Waste Electrical and Electronic Equipment (WEEE), End of Life Vehicle Directive (ELV), ammonia, and the like.

The more recent use of stabilizers other than lead in electroless nickel plating baths has enabled the utility of the present invention. Lead, the traditional stabilizer in electroless nickel systems, works in the plating bath in a very tight range of about 1 to 3 parts per million. Too little lead and the bath will produce plating defects, become over active, and/or decompose. Too much lead and the bath will produce plating defects, plate too slowly, and/or stop plating. Keeping the lead stabilizer within the tight range required for proper bath operation, proper plating quality and proper bath life is one of the reasons why a single solution useful for the make up and replenishment of an electroless plating bath was not possible until the present invention. In a preferred embodiment of the present invention, the single solution useful for the make up and replenishment of an electroless plating bath uses materials other than lead, and these other materials are able to stabilize the plating bath within a much broader range than the traditional lead stabilizers. Such non-lead stabilizers include, but are not limited to bismuth, copper, antimony, and non-metal stabilizers either individually or in combination. For example, lead is generally effective in the range of only about 1 to 3 parts per million in an electroless nickel plating bath, whereas bismuth is effective in the range of about 1 to 50 parts per million in an electroless nickel plating bath.

Similarly, thiourea has been widely accepted and used as a traditional sulfur compound stabilizer in electroless nickel plating baths. Sulfur functions in an electroless nickel system mainly as stabilizer, the ratio of sulfur to the lead or other metal stabilizer in the plating bath can affect the performance of the plating bath and the properties of the plating itself. And similar to lead, thiourea works in the plating bath in a very tight range. Too little thiourea and the bath will produce plating defects and/or decompose. Too much thiourea and the bath will produce plating defects and/or stop plating. In a preferred embodiment of the present invention, the single solution useful for the make up and replenishment of an electroless plating bath can use materials other than thiourea, and these other materials are able to function in the plating bath within a much broader range than the traditional thiourea. Such non-thiourea sulfur compounds include, but are not limited to thiosalicylic acid, thiodipropionic acid, and the like. For example, thiourea is generally effective in the range of only about 1 to 5 parts per million in an electroless nickel plating bath, whereas thiosalicylic acid is effective in the range of about 1 to 30 parts per million in an electroless nickel plating bath, and thiodipropionic acid is effective in the range of about 1 to 300 parts per million in an electroless nickel plating bath.

In one preferred embodiment of the present invention, the solution useful for both the make up and replenishment of an electroless plating bath will contain one or more of the following ingredients: metal salt, reducing agent, complexer, pH adjuster, and stabilizer.

In one preferred embodiment of the present invention, the solution useful for both makeup and replenishment of an electroless plating bath will have a pH of about 6.0.

In one preferred embodiment of the present invention, the solution useful for both makeup and replenishment of an electroless plating bath will be able to maintain the pH of the plating bath with little to no auxiliary additions of a pH adjuster.

In one preferred embodiment of the present invention, the solution useful for both makeup and replenishment of an electroless plating bath will produce a high phosphorus alloy of electroless nickel. This plated alloy may withstand one or more of the following: salt spray erosion testing, porosity testing, and/or nitric acid testing to a degree consistent with commonly accepted commercial levels.

In one preferred embodiment of the present invention, the solution useful for both makeup and replenishment of a plating bath will be for an electroless nickel plating bath with a nickel content in the range of 5 g/L and a sodium hypophosphite content in the range of 25 g/L.

In one preferred embodiment of the present invention, the solution for both makeup and replenishment will be useful for multiple types of plating baths.

In one preferred embodiment of the present invention, the solution useful for both makeup and replenishment of a plating bath will be stable from −10 to 45° C.

Although the examples detailed below depict specific combinations of components, time, and control, the reader should recognize that the present invention is not limited to the specific materials and metrics in the examples. For example, plating different goods may require different quantities or combinations. The pH of the plating bath can vary by application but is preferably in a range of 4.0 to 9.0. The plating bath temperatures can preferably be in the range of 20 to 100 degrees Celsius. The duration of the cycle times can be in any range required to provide the coating thickness and properties desired.

The present invention is directed to a single solution useful for the make-up and replenishment of a plating bath that is useful and economical on a commercial basis. The present invention is further directed towards a single solution that is useful for the make-up and replenishment of a plating bath that is capable of producing plating performance and coatings that are free of problems in the deposit being caused by the solution. Such problems include, but are not limited to skip plating, pitting, edge pull-back, step plating, dark or laminar deposit, roughness in deposits, streaks in deposit, dull or matte deposits, poor adhesion of the deposit to the substrate, poor corrosion and/or chemical resistance of the deposit.

The single solution of the present invention can take any of several forms, such as but not limited to the forms described in Chart 1 (in FIGS. 1A-1E). Chart 1 depicts specific examples of combinations of component materials, however, it is understood that these examples are merely representative of potential ranges of combinations of component materials. The ratios of such component materials may be in a variety of ranges, where the ranges may roughly be within the ranges shown in the chart. In general, these solutions include one or more metal salts, complexers, reducing agents, pH adjusters, and stabilizers, and may also contain one or more forms of particulate matter and particulate matter stabilizers. In the preferred embodiment, the single solution is used for formulating a bath further comprising water, where the bath is carefully controlled with respect to pH and temperature, and the plating rate is also carefully controlled.

The solution of the present invention's contents will vary based on the plating needs, such as but not limited to, the type of plating necessary, and the types of objects being plated. Preferably, the solution is directed to electroless nickel plating, but other types of plating may also lend themselves to a single solution.

Again, the initial solution and the replenishment solution of the present invention are the same. In general, during plating, the individual contents of the single solution will deplete from the bath, and the introduction of replenishment solution may change the overall mix in some ways (consequential to variation in the depletion rates of the various component elements), but the overall ability to plate and for the bath to remain usable will not be impacted by the introduction of replenishment solution.

EXAMPLES

A solution as listed in each of the columns D through AR in Chart 1 (in FIGS. 1A-1E) was prepared with quantities recorded of the ingredients as in rows 7 through 44 of Chart 1 (in FIGS. 1A-1E) by dissolving these ingredients in water. Each of these examples describes a solution usable as both an initial solution where water is added and is also usable as a replenishment solution, typically without the need to add additional water. All of these solutions have been tested in controlled environments where the environment is described in the bottom rows. Of course, different of these examples might be applicable to different plating situations, however, each has been shown to be usable in the single solution composition described in this application. In the solutions listed in each of the columns Q through AA and AC through AE, insoluble particulate matter was also added as listed in rows 41 through 44. Column C in Chart 1 (in FIGS. 1A-1E) discloses the units of measurement of each ingredient added to each solution.

Each of the above solutions was stored at room temperature of 20 degrees Celsius for 15 days and inspected for precipitation or other degradation. The same solutions were then stored in a −5 degree Celsius environment for 30 days, removed from this environment and inspected for precipitation or other degradation, then stored in a 40-45 degree Celsius environment for 30 days, removed from this environment, and inspected to for precipitation or other degradation.

A quantity of each of the above solutions was diluted to one liter with deionized water to form an electroless plating bath. The quantity of the solution that was diluted to a one liter plating bath is listed in row 47 of Chart 1 (in FIGS. 1A-1E). Mild agitation was introduced to the bath. The pH of this bath may have then been adjusted with an auxiliary solution to achieve the pH listed in row 48 of Chart 1 (in FIGS. 1A-1E) for each plating bath. The bath was then heated to the operating temperature listed in row 49 of Chart 1 (in FIGS. 1A-1E) for each plating bath.

Substrates made of steel, stainless steel, copper and aluminum alloys were cleaned and otherwise pretreated and immersed in the plating baths listed in Chart 1 (in FIGS. 1A-1E). The substrates were left in the plating baths for cycle times from 15 to 240 minutes, during which time the pH, temperature and agitation of the plating baths were maintained. The substrates were removed and both the substrates and plating baths were analyzed.

Each of the plating baths were analyzed by titration for the metal salt concentration and replenished with the required quantity of the exact same solution used in the make up of the respective plating bath to return metal salt concentration of the plating bath to the same starting concentration as its initial make up. The solution as used for replenishment was the exact same as used for make up of the plating bath in each example as on Chart 1 (in FIGS. 1A-1E). The replenishment of the plating bath was made before, during and after the substrates were being plated in the plating bath.

This process of plating substrates, analyzing the substrates, analyzing the baths, and replenishing the baths was continued until the baths reached at least one metal turnover. This process was implemented at timing consistent with conventional plating practice in order to maintain the concentration of materials in the plating bath in a useful range. Throughout the process, the pH, temperature and agitation were maintained, and the plating reaction was observed by the bubbles evolving from the substrates. Throughout the process, the plating rates were measured and recorded in row 50 of Chart 1 (in FIGS. 1A-1E) for each respective plating bath. This process was performed on each of the plating baths in Chart 1 (in FIGS. 1A-1E) over the course of a number of days with the baths cooled at the end of use on one day and reheated to the operating temperature on the following day. This process is representative of the typical usage of a plating bath in a commercial practice.

The electroless platings produced by each of the plating baths made from each of the solutions in Chart 1 (in FIGS. 1A-1E) were analyzed. In those examples, where insoluble particulate matter was included in the solution used in each of these plating baths, the resulting platings were analyzed by cross sectional examination to verify the incorporation of these particulate materials in the plating.

Additional Examples

Example 1

An aqueous solution was prepared with: nickel sulfate, sodium hypophosphite and other ingredients useful in electroless nickel plating.

200 ml of the above solution was diluted to one liter with deionized water to form an electroless plating bath. Mild agitation was introduced to the bath. The pH of this bath was adjusted to with ammonium hydroxide. The bath was then heated to an operating temperature. Titration analyses indicated a nickel concentration of 6 grams per liter and a hypophosphite concentration of 30 grams per liter.

A substrate was pretreated and immersed in the plating bath. The substrate was left in the plating bath for 60 minutes, during which time the pH, temperature and agitation maintained, and the plating reaction remained evident from the bubbles evolving from the substrate.

After 60 minutes of plating time, the substrate was removed and both the substrate and bath were analyzed.

The substrate exhibited a uniform 20 microns thick nickel-phosphorous layer free of irregularities.

The bath was analyzed by titrations to contain a nickel concentration of 5.52 grams per liter and a hypophosphite concentration of 27.6 grams per liter, therefore demonstrating an 8% depletion of the initial content of these ingredients. The bath was replenished to 100% concentration with an addition of 16 ml of the solution prepared above. This cycle thereby representing 8% of one metal turn-over (MTO).

This process of plating substrates, analyzing the substrates, analyzing the bath, and replenishing the bath was continued until the bath reached a cumulative one MTO. Throughout the process, the pH, temperature and agitation were maintained, and the plating reaction remained evident from the bubbles evolving from the substrate. The substrates exhibited a uniform nickel-phosphorous layer free of irregularities achieved at a plating rate between 17 and 22 microns per hour. This process was performed on this plating bath over the course of a number of days with the bath cooled at the end of use on one day and reheated to the operating temperature on the following day. This process is representative of the typical usage of a plating bath in a commercial practice.

Example 2

An aqueous solution was prepared with: nickel sulfate, sodium hypophosphite and other ingredients useful in electroless nickel plating.

200 ml of the above solution was diluted to one liter with deionized water to form an electroless plating bath. Mild agitation was introduced to the bath. The pH of this bath was adjusted to with ammonium hydroxide. The bath was then heated to an operating temperature. Titration analyses indicated a nickel concentration of 3 grams per liter and a hypophosphite concentration of 30 grams per liter.

A substrate was pretreated and immersed in the plating bath. The substrate was left in the plating bath for 60 minutes, during which time the pH, temperature and agitation maintained, and the plating reaction remained evident from the bubbles evolving from the substrate.

After 60 minutes of plating time, the substrate was removed and both the substrate and bath were analyzed.

The substrate exhibited a uniform 19 microns thick nickel-phosphorous layer free of irregularities.

The bath was analyzed every 20 minutes during the course of this 60 minute plating cycle by titrations and each time found to contain a nickel concentration of about 2.7 grams per liter, therefore demonstrating a 10% depletion of the initial content of these ingredients. Each time, the bath was replenished to 100% concentration with an addition of 20 ml of the solution prepared above. This cycle thereby representing 10% of one metal turn-over (MTO) every 20 minutes or 30% of one MTO every 60 minute plating cycle.

This process of plating substrates, analyzing the substrates, analyzing the bath, and replenishing the bath was continued until the bath reached a cumulative one MTO. Throughout the process, the pH, temperature and agitation were maintained, and the plating reaction remained evident from the bubbles evolving from the substrate. The substrates exhibited a uniform nickel-phosphorous layer free of irregularities achieved at a plating rate between 17 and 22 microns per hour. This process was performed on this plating bath over the course of a number of days with the bath cooled at the end of use on one day and reheated to the operating temperature on the following day. This process is representative of the typical usage of a plating bath in a commercial practice.

Example 3

An aqueous solution was prepared with: nickel sulfate, sodium hypophosphite and other ingredients useful in electroless nickel plating. This solution had a pH of about 6.0.

150 ml of the above solution was diluted to one liter with deionized water to form an electroless plating bath. Mild agitation was introduced to the bath. The pH of this bath was about 6.0 as made up above. The bath was then heated to an operating temperature. Titration analyses indicated a nickel concentration of 5 grams per liter and a hypophosphite concentration of 25 grams per liter.

A substrate was pretreated and immersed in the plating bath. The substrate was left in the plating bath for 60 minutes, during which time the temperature and agitation maintained, and the plating reaction remained evident from the bubbles evolving from the substrate.

After 60 minutes of plating time, the substrate was removed and both the substrate and bath were analyzed.

The substrate exhibited a uniform 20 microns thick nickel-phosphorous layer free of irregularities.

The bath was analyzed by titrations to determine the nickel concentration and consequently the nickel depletion caused by the plating onto the substrate. The bath was replenished to 100% concentration of nickel with an addition of the solution prepared above.

This process of plating substrates, analyzing the substrates, analyzing the bath, and replenishing the bath was continued until the bath reached a cumulative 12 MTOs. Throughout the process, the temperature and agitation were maintained, and the plating reaction remained evident from the bubbles evolving from the substrate. Throughout the process, the pH of the plating bath decreased during each plating cycle, but returned to about 6.0 following the replenishment of the solution prepared above, without auxiliary additions of pH adjusters. The substrates exhibited a uniform nickel-phosphorous layer free of irregularities achieved at a plating rate between 17 and 22 microns per hour. This process was performed on this plating bath over the course of a number of days with the bath cooled at the end of use on one day and reheated to the operating temperature on the following day. This process is representative of the typical usage of a plating bath in a commercial practice.

Example 4

An aqueous solution was prepared with: nickel sulfate, sodium hypophosphite and other ingredients useful in electroless nickel plating. This solution had a pH of about 6.0.

150 ml of the above solution was diluted to one liter with deionized water to form an electroless plating bath. Mild agitation was introduced to the bath. The pH of this bath was about 6.0 as made up above, and then adjusted with a 25% solution of sulfuric acid to a pH of about 4.8. The bath was then heated to an operating temperature. Titration analyses indicated a nickel concentration of 5 grams per liter and a hypophosphite concentration of 25 grams per liter.

A substrate was pretreated and immersed in the plating bath. The substrate was left in the plating bath for 60 minutes, during which time the temperature and agitation maintained, and the plating reaction remained evident from the bubbles evolving from the substrate.

After 60 minutes of plating time, the substrate was removed and both the substrate and bath were analyzed.

The substrate exhibited a uniform 19 microns thick nickel-phosphorous layer free of irregularities.

The bath was analyzed by titrations to determine the nickel concentration and consequently the nickel depletion caused by the plating onto the substrate. The bath was replenished to 100% concentration of nickel with an addition of the solution prepared above.

This process of plating substrates, analyzing the substrates, analyzing the bath, and replenishing the bath was continued until the bath reached a cumulative 1.3 MTOs. Throughout the process, the temperature and agitation were maintained, and the plating reaction remained evident from the bubbles evolving from the substrate. Throughout the process, the pH of the plating bath decreased during each plating cycle, but returned to about 4.8 following the replenishment of the solution prepared above, without auxiliary additions of pH adjusters. The substrates exhibited a uniform nickel-phosphorous layer free of irregularities achieved at a plating rate between 18 and 20 microns per hour. This process was performed on this plating bath over the course of a number of days with the bath cooled at the end of use on one day and reheated to the operating temperature on the following day. This process is representative of the typical usage of a plating bath in a commercial practice. This experiment was stopped at this point as the pH maintenance of the bath was demonstrated; the performance of the plating bath remained useful and could have been continued for a much longer bath lifetime.

Example 5

An aqueous solution was prepared with: nickel sulfate, sodium hypophosphite and other ingredients useful in electroless nickel plating. This solution had a pH of about 5.2.

150 ml of the above solution was diluted to one liter with deionized water to form an electroless plating bath. Mild agitation was introduced to the bath. The pH of this bath was about 5.2 as made up above. The pH of the plating bath was then reduced to about 4.8 with the addition of an appropriate amount of 25% sulfuric acid. The bath was then heated to an operating temperature. Titration analyses indicated a nickel concentration of 5 grams per liter and a hypophosphite concentration of 25 grams per liter.

A substrate was pretreated and immersed in the plating bath. The substrate was left in the plating bath for 60 minutes, during which time the pH, temperature and agitation maintained, and the plating reaction remained evident from the bubbles evolving from the substrate.

After 60 minutes of plating time, the substrate was removed and both the substrate and bath were analyzed.

The substrate exhibited a uniform 10 microns thick nickel-phosphorous layer free of irregularities. The substrate was then immersed halfway into concentrated nitric acid for 60 seconds, then removed and inspected to show no discoloration from the immersion in nitric acid.

The bath was analyzed by titrations to determine the nickel concentration and consequently the nickel depletion caused by the plating onto the substrate. The bath was replenished to 100% concentration of nickel with an addition of the solution prepared above.

This process of plating substrates, analyzing the substrates, analyzing the bath, and replenishing the bath was continued until the bath reached a cumulative 7.4 MTOs. Throughout the process, the temperature and agitation were maintained, and the plating reaction remained evident from the bubbles evolving from the substrate. Throughout the process, the pH of the plating bath decreased during each plating cycle, but returned to about 4.8 following the replenishment of the solution prepared above, without auxiliary additions of pH adjusters. The substrates exhibited a uniform nickel-phosphorous layer free of irregularities achieved at a plating rate between 7 and 10 microns per hour. This process was performed on this plating bath over the course of a number of days with the bath cooled at the end of use on one day and reheated to the operating temperature on the following day. This process is representative of the typical usage of a plating bath in a commercial practice.

Example 6

An aqueous solution was prepared with: nickel sulfate, sodium hypophosphite and other ingredients useful in electroless nickel plating. This solution had a pH of about 5.2.

150 ml of the above solution was diluted to one liter with deionized water to form an electroless plating bath. Mild agitation was introduced to the bath. To this plating bath was added an anti-pitting agent. The pH of this bath was about 5.2 as made up above. The pH of the plating bath was then reduced to about 4.8 with the addition of an appropriate amount of 25% sulfuric acid. The bath was then heated to an operating temperature. Titration analyses indicated a nickel concentration of 5 grams per liter and a hypophosphite concentration of 25 grams per liter.

A substrate was pretreated and immersed in the plating bath. The substrate was left in the plating bath for 60 minutes, during which time the pH, temperature and agitation maintained, and the plating reaction remained evident from the bubbles evolving from the substrate.

After 60 minutes of plating time, the substrate was removed and both the substrate and bath were analyzed.

The substrate exhibited a uniform 10 microns thick nickel-phosphorous layer free of irregularities. The substrate was then immersed halfway into concentrated nitric acid for 60 seconds, then removed and inspected to show no discoloration from the immersion in nitric acid.

The bath was analyzed by titrations to determine the nickel concentration and consequently the nickel depletion caused by the plating onto the substrate. The bath was replenished to 100% concentration of nickel with an addition of the solution prepared above.

This process of plating substrates, analyzing the substrates, analyzing the bath, and replenishing the bath was continued until the bath reached a cumulative 1 MTO. Throughout the process, the temperature and agitation were maintained, and the plating reaction remained evident from the bubbles evolving from the substrate. Throughout the process, the pH of the plating bath decreased during each plating cycle, but returned to about 4.8 following the replenishment of the solution prepared above, without auxiliary additions of pH adjusters. The substrates exhibited a uniform nickel-phosphorous layer free of irregularities achieved at a plating rate between 7 and 10 microns per hour. This process was performed on this plating bath over the course of a number of days with the bath cooled at the end of use on one day and reheated to the operating temperature on the following day. This process is representative of the typical usage of a plating bath in a commercial practice.

Example 7

An aqueous solution was prepared with: nickel sulfate, sodium hypophosphite and other ingredients useful in electroless nickel plating. This solution had a pH of about 6.0.

150 ml of the above solution was diluted to one liter with deionized water to form an electroless plating bath. 5 grams of a PTFE dispersion containing 60% by weight PTFE particles as well as PMS's useful in the codeposition of PTFE in an electroless nickel bath were added to the bath. Mild agitation was introduced to the bath. The pH of this bath was about 6.0 as made up above. The bath was then heated to an operating temperature. Titration analyses indicated a nickel concentration of 5 grams per liter and a hypophosphite concentration of 25 grams per liter.

A substrate was pretreated and immersed in the plating bath. The substrate was left in the plating bath for 60 minutes, during which time the temperature and agitation maintained, and the plating reaction remained evident from the bubbles evolving from the substrate.

After 60 minutes of plating time, the substrate was removed and both the substrate and bath were analyzed.

The substrate exhibited a uniform 8 microns thick composite nickel-phosphorous-PTFE layer free of irregularities.

The bath was analyzed by titrations to determine the nickel concentration and consequently the nickel depletion caused by the plating onto the substrate. The bath was replenished to 100% concentration of nickel with an addition of the solution prepared above.

This process of plating substrates, analyzing the substrates, analyzing the bath, and replenishing the bath was continued until the bath reached a cumulative 8.9 MTOs. Throughout the process, the PTFE content in the plating bath was analyzed and additional of the PTFE dispersion was added to the plating bath as needed in order to maintain the PTFE concentration in the plating bath at about 5 grams per liter. Throughout the process, the temperature and agitation were maintained, and the plating reaction remained evident from the bubbles evolving from the substrate. Throughout the process, the pH of the plating bath decreased during each plating cycle, but returned to about 5.8 to 6.0 following the replenishment of the solution prepared above, without auxiliary additions of pH adjusters. The substrates exhibited a uniform nickel-phosphorous-PTFE layer free of irregularities achieved at a plating rate between 7 and 10 microns per hour. This process was performed on this plating bath over the course of a number of days with the bath cooled at the end of use on one day and reheated to the operating temperature on the following day. This process is representative of the typical usage of a plating bath in a commercial practice.

Example 8

An aqueous solution was prepared with: nickel sulfate, sodium hypophosphite and other ingredients useful in high phosphorus electroless nickel plating. This solution had a pH of about 6.0.

150 ml of the above solution was diluted to one liter with deionized water to form an electroless plating bath. 6 grams of a PTFE dispersion containing 60% by weight PTFE particles as well as PMS's useful in the codeposition of PTFE in an electroless nickel bath were added to the bath. Mild agitation was introduced to the bath. The pH of this bath was about 6.0 as made up above. The pH of this plating bath was then lowered to about 4.8 with 25% sulfuric acid. The bath was then heated to an operating temperature. Titration analyses indicated a nickel concentration of 5 grams per liter and a hypophosphite concentration of 25 grams per liter.

A substrate was pretreated and immersed in the plating bath. The substrate was left in the plating bath for 60 minutes, during which time the temperature and agitation maintained, and the plating reaction remained evident from the bubbles evolving from the substrate.

After 60 minutes of plating time, the substrate was removed and both the substrate and bath were analyzed.

The substrate exhibited a uniform 9 microns thick composite nickel-phosphorous-PTFE layer free of irregularities.

The bath was analyzed by titrations to determine the nickel concentration and consequently the nickel depletion caused by the plating onto the substrate. The bath was replenished to 100% concentration of nickel with an addition of the solution prepared above.

This process of plating substrates, analyzing the substrates, analyzing the bath, and replenishing the bath was continued until the bath reached a cumulative 4.8 MTOs. Throughout the process, the PTFE content in the plating bath was analyzed and additional of the PTFE dispersion was added to the plating bath as needed in order to maintain the PTFE concentration in the plating bath at about 6 grams per liter. Throughout the process, the temperature and agitation were maintained, and the plating reaction remained evident from the bubbles evolving from the substrate. Throughout the process, the pH of the plating bath decreased during each plating cycle, but returned to about 4.8 following the replenishment of the solution prepared above, without auxiliary additions of pH adjusters. The substrates exhibited a uniform nickel-phosphorous-PTFE layer free of irregularities achieved at a plating rate between 7 and 10 microns per hour. This process was performed on this plating bath over the course of a number of days with the bath cooled at the end of use on one day and reheated to the operating temperature on the following day. This process is representative of the typical usage of a plating bath in a commercial practice.

Example 9

An aqueous concentrate solution was prepared with: a complexing agent, a pH adjuster, a stabilizer, and other ingredients useful in electroless nickel plating. This concentrate solution had a pH of about 9.0.

To 75 ml of the above concentrate solution was added a metal salt and a reducing agent and then diluted to 150 ml with deionized water to form an aqueous plating solution. This 150 ml plating solution was diluted to one liter with deionized water to form an electroless plating bath. Mild agitation was introduced to the bath. The pH of this bath was about 6.0 as made up above. The bath was then heated to an operating temperature. Titration analyses indicated a nickel concentration of 5 grams per liter and a hypophosphite concentration of 25 grams per liter.

A substrate was pretreated and immersed in the plating bath. The substrate was left in the plating bath for 60 minutes, during which time the temperature and agitation maintained, and the plating reaction remained evident from the bubbles evolving from the substrate.

After 60 minutes of plating time, the substrate was removed and both the substrate and bath were analyzed.

The substrate exhibited a uniform 20 microns thick nickel-phosphorous layer free of irregularities.

The bath was analyzed by titrations to determine the nickel concentration and consequently the nickel depletion caused by the plating onto the substrate. The bath was replenished to 100% concentration of nickel with an addition of the solution prepared above.

This process of plating substrates, analyzing the substrates, analyzing the bath, and replenishing the bath was continued until the bath reached a cumulative 12 MTOs. Throughout the process, the temperature and agitation were maintained, and the plating reaction remained evident from the bubbles evolving from the substrate. Throughout the process, the pH of the plating bath decreased during each plating cycle, but returned to about 6.0 following the replenishment of the solution prepared above, without auxiliary additions of pH adjusters. The substrates exhibited a uniform nickel-phosphorous layer free of irregularities achieved at a plating rate between 17 and 22 microns per hour. This process was performed on this plating bath over the course of a number of days with the bath cooled at the end of use on one day and reheated to the operating temperature on the following day. This process is representative of the typical usage of a plating bath in a commercial practice.

Example 10

An aqueous concentrate solution was prepared with: a complexing agent, a pH adjuster, a stabilizer, and other ingredients useful in electroless nickel plating. This concentrate solution had a pH of about 9.0.

A one-liter electroless plating bath was formed with 75 ml of the above concentrate solution, a metal salt, and a reducing agent and deionized water to form an electroless plating bath. Mild agitation was introduced to the bath. The pH of this bath was about 6.0 as made up above. The bath was then heated to an operating temperature. Titration analyses indicated a nickel concentration of 5 grams per liter and a hypophosphite concentration of 25 grams per liter.

A substrate was pretreated and immersed in the plating bath. The substrate was left in the plating bath for 60 minutes, during which time the temperature and agitation maintained, and the plating reaction remained evident from the bubbles evolving from the substrate.

After 60 minutes of plating time, the substrate was removed and both the substrate and bath were analyzed.

The substrate exhibited a uniform 20 microns thick nickel-phosphorous layer free of irregularities.

The bath was analyzed by titrations to determine the nickel concentration and consequently the nickel depletion caused by the plating onto the substrate. The bath was replenished to 100% concentration of nickel, reducing agent, with the additions of the appropriate amounts of the metal salt and reducing agent used above as well as the concentrate solution.

This process of plating substrates, analyzing the substrates, analyzing the bath, and replenishing the bath was continued until the bath reached a cumulative 12 MTOs. Throughout the process, the temperature and agitation were maintained, and the plating reaction remained evident from the bubbles evolving from the substrate. Throughout the process, the pH of the plating bath decreased during each plating cycle, but returned to about 6.0 following the replenishment of the solution prepared above, without auxiliary additions of pH adjusters. The substrates exhibited a uniform nickel-phosphorous layer free of irregularities achieved at a plating rate between 17 and 22 microns per hour. This process was performed on this plating bath over the course of a number of days with the bath cooled at the end of use on one day and reheated to the operating temperature on the following day. This process is representative of the typical usage of a plating bath in a commercial practice.

Example 11

3.785 liters of an aqueous solution was prepared with: nickel sulfate, sodium hypophosphite and other ingredients useful in electroless nickel plating. This solution had a pH of about 6.0.

150 ml of the above solution was diluted to one liter with deionized water to form an electroless plating bath. Mild agitation was introduced to the bath. The pH of this bath was about 6.0 as made up above. The bath was then heated to an operating temperature. Titration analyses indicated a nickel concentration of 5 grams per liter and a hypophosphite concentration of 25 grams per liter.

A substrate was pretreated and immersed in the plating bath. The substrate was left in the plating bath for 60 minutes, during which time the temperature and agitation maintained, and the plating reaction remained evident from the bubbles evolving from the substrate.

After 60 minutes of plating time, the substrate was removed and both the substrate and bath were analyzed.

The substrate exhibited a uniform 20 microns thick nickel-phosphorous layer free of irregularities.

The bath was analyzed by titrations to determine the nickel concentration and consequently the nickel depletion caused by the plating onto the substrate. The bath was replenished to 100% concentration of nickel with an addition of the solution prepared above.

This process of plating substrates, analyzing the substrates, analyzing the bath, and replenishing the bath was continued until the bath reached a cumulative 12 MTOs. Throughout the process, the temperature and agitation were maintained, and the plating reaction remained evident from the bubbles evolving from the substrate. Throughout the process, the pH of the plating bath decreased during each plating cycle, but returned to about 6.0 following the replenishment of the solution prepared above, without auxiliary additions of pH adjusters. The substrates exhibited a uniform nickel-phosphorous layer free of irregularities achieved at a plating rate between 17 and 22 microns per hour. This process was performed on this plating bath over the course of a number of days with the bath cooled at the end of use on one day and reheated to the operating temperature on the following day. This process is representative of the typical usage of a plating bath in a commercial practice.

150 ml of the above solution was diluted to one liter with deionized water to form an electroless plating bath. 5 grams of a PTFE dispersion containing 60% by weight PTFE particles as well as PMS's useful in the codeposition of PTFE in an electroless nickel bath were added to the bath. Mild agitation was introduced to the bath. The pH of this bath was about 6.0 as made up above. The bath was then heated to an operating temperature. Titration analyses indicated a nickel concentration of 5 grams per liter and a hypophosphite concentration of 25 grams per liter.

A substrate was pretreated and immersed in the plating bath. The substrate was left in the plating bath for 60 minutes, during which time the pH, temperature and agitation maintained, and the plating reaction remained evident from the bubbles evolving from the substrate.

After 60 minutes of plating time, the substrate was removed and both the substrate and bath were analyzed.

The substrate exhibited a uniform 7 microns thick composite nickel-phosphorous-PTFE layer free of irregularities.

The bath was analyzed by titrations to determine the nickel concentration and consequently the nickel depletion caused by the plating onto the substrate. The bath was replenished to 100% concentration of nickel with an addition of the solution prepared above.

This process of plating substrates, analyzing the substrates, analyzing the bath, and replenishing the bath was continued until the bath reached a cumulative 8.5 MTOs. Throughout the process, the PTFE content in the plating bath was analyzed and additional of the PTFE dispersion was added to the plating bath as needed in order to maintain the PTFE concentration in the plating bath at about 5 grams per liter. Throughout the process, the temperature and agitation were maintained, and the plating reaction remained evident from the bubbles evolving from the substrate. Throughout the process, the pH of the plating bath decreased during each plating cycle, but returned to about 6.0 following the replenishment of the solution prepared above, without auxiliary additions of pH adjusters. The substrates exhibited a uniform nickel-phosphorous-PTFE layer free of irregularities achieved at a plating rate between 6 and 10 microns per hour. This process was performed on this plating bath over the course of a number of days with the bath cooled at the end of use on one day and reheated to the operating temperature on the following day. This process is representative of the typical usage of a plating bath in a commercial practice.

150 ml of the above solution was diluted to one liter with deionized water to form an electroless plating bath. 18 ml of a diamond dispersion containing 350 grams per liter of diamond particles was added to the bath. Mild agitation was introduced to the bath. The pH of this bath was about 6.0 as made up above. The bath was then heated to an operating temperature. Titration analyses indicated a nickel concentration of 5 grams per liter and a hypophosphite concentration of 25 grams per liter.

A substrate was pretreated and immersed in the plating bath. The substrate was left in the plating bath for 60 minutes, during which time the pH, temperature and agitation maintained, and the plating reaction remained evident from the bubbles evolving from the substrate.

After 60 minutes of plating time, the substrate was removed and both the substrate and bath were analyzed.

The substrate exhibited a uniform 26 microns thick composite nickel-phosphorous-diamond layer free of irregularities.

The bath was analyzed by titrations to determine the nickel concentration and consequently the nickel depletion caused by the plating onto the substrate. The bath was replenished to 100% concentration of nickel with an addition of the solution prepared above.

This process of plating substrates, analyzing the substrates, analyzing the bath, and replenishing the bath was continued until the bath reached a cumulative 2.5 MTOs. Throughout the process, the diamond content in the plating bath was analyzed and additional of the diamond dispersion was added to the plating bath as needed in order to maintain the diamond concentration in the plating bath at its initial level. Throughout the process, the temperature and agitation were maintained, and the plating reaction remained evident from the bubbles evolving from the substrate. Throughout the process, the pH of the plating bath decreased during each plating cycle, but returned to about 6.0 following the replenishment of the solution prepared above, without auxiliary additions of pH adjusters. The substrates exhibited a uniform nickel-phosphorous-diamond layer free of irregularities achieved at a plating rate between 20 and 30 microns per hour. This process was performed on this plating bath over the course of a number of days with the bath cooled at the end of use on one day and reheated to the operating temperature on the following day. This process is representative of the typical usage of a plating bath in a commercial practice.

150 ml of the above solution was diluted to one liter with deionized water to form an electroless plating bath. 20 ml of a silicon carbide dispersion containing 350 grams per liter of silicon carbide particles was added to the bath. Mild agitation was introduced to the bath. The pH of this bath was about 6.0 as made up above. The bath was then heated to an operating temperature. Titration analyses indicated a nickel concentration of 5 grams per liter and a hypophosphite concentration of 25 grams per liter.

A substrate was pretreated and immersed in the plating bath. The substrate was left in the plating bath for 60 minutes, during which time the pH, temperature and agitation maintained, and the plating reaction remained evident from the bubbles evolving from the substrate.

After 60 minutes of plating time, the substrate was removed and both the substrate and bath were analyzed.

The substrate exhibited a uniform 18 microns thick composite nickel-phosphorous-silicon carbide layer free of irregularities.

The bath was analyzed by titrations to determine the nickel concentration and consequently the nickel depletion caused by the plating onto the substrate. The bath was replenished to 100% concentration of nickel with an addition of the solution prepared above.

This process of plating substrates, analyzing the substrates, analyzing the bath, and replenishing the bath was continued until the bath reached a cumulative 2 MTOs. Throughout the process, the silicon carbide content in the plating bath was analyzed and additional of the silicon carbide dispersion was added to the plating bath as needed in order to maintain the silicon carbide concentration in the plating bath at its initial level. Throughout the process, the temperature and agitation were maintained, and the plating reaction remained evident from the bubbles evolving from the substrate. Throughout the process, the pH of the plating bath decreased during each plating cycle, but returned to about 6.0 following the replenishment of the solution prepared above, without auxiliary additions of pH adjusters. The substrates exhibited a uniform nickel-phosphorous-silicon carbide layer free of irregularities achieved at a plating rate between 16 and 22 microns per hour. This process was performed on this plating bath over the course of a number of days with the bath cooled at the end of use on one day and reheated to the operating temperature on the following day. This process is representative of the typical usage of a plating bath in a commercial practice.

150 ml of the above solution was diluted to one liter with deionized water to form an electroless plating bath. 50 ml of a boron nitride dispersion containing 211 grams per liter of boron nitride particles was added to the bath. Mild agitation was introduced to the bath. The pH of this bath was about 6.0 as made up above. The bath was then heated to an operating temperature. Titration analyses indicated a nickel concentration of 5 grams per liter and a hypophosphite concentration of 25 grams per liter.

A substrate was pretreated and immersed in the plating bath. The substrate was left in the plating bath for 60 minutes, during which time the pH, temperature and agitation maintained, and the plating reaction remained evident from the bubbles evolving from the substrate.

After 60 minutes of plating time, the substrate was removed and both the substrate and bath were analyzed.

The substrate exhibited a uniform 18 microns thick composite nickel-phosphorous-boron nitride layer free of irregularities.

The bath was analyzed by titrations to determine the nickel concentration and consequently the nickel depletion caused by the plating onto the substrate. The bath was replenished to 100% concentration of nickel with an addition of the solution prepared above.

This process of plating substrates, analyzing the substrates, analyzing the bath, and replenishing the bath was continued until the bath reached a cumulative 8 MTOs. Throughout the process, the boron nitride content in the plating bath was analyzed and additional of the boron nitride dispersion was added to the plating bath as needed in order to maintain the boron nitride concentration in the plating bath at its initial level. Throughout the process, the temperature and agitation were maintained, and the plating reaction remained evident from the bubbles evolving from the substrate. Throughout the process, the pH of the plating bath decreased during each plating cycle, but returned to about 6.0 following the replenishment of the solution prepared above, without auxiliary additions of pH adjusters. The substrates exhibited a uniform nickel-phosphorous-boron nitride layer free of irregularities achieved at a plating rate between 15 and 20 microns per hour. This process was performed on this plating bath over the course of a number of days with the bath cooled at the end of use on one day and reheated to the operating temperature on the following day. This process is representative of the typical usage of a plating bath in a commercial practice.

The invention claimed is:

1. A single plating solution configured to be an initial solution added to water to form a plating bath and as a replenishment solution for the same plating bath comprising, in the same defined concentrations:

a metal salt;

a complexer, said complexer selected from the group consisting of lactic acid, malic acid, maleic anhydride, glycine, citric acid, citrates, glycolic acid or salts, succinic acid or salts, beta-alanine, EDTA, ammonium carbonate, ammonium chloride, propionic acid, tetra potassium pyrophosphate, and boric acid;

a reducing agent;

at least one pH adjuster; and at least one stabilizer for stabilizing a plating reaction.

2. The plating solution of claim 1, further comprising at least one type of particulate matter stabilizer.

3. The plating solution of claim 1, wherein said stabilizer is selected from the group consisting of lead, bismuth, tin, copper, antimony, sulfur, and non-metal stabilizers.

4. The plating solution of claim 1, further comprising at least one selected from the group consisting of a brightener, a buffer, an anti-pit agent, or an accelerator.

5. The plating solution of claim 1, wherein said plating solution has a pH in a range of about 5.0-7.0.

6. The plating solution of claim 1, wherein said plating solution is stable in a temperature range of −5 to 45° C.

7. The plating solution of claim 1, wherein the articles plated in said plating bath are conformant to RoHS, ELV, and WEEE regulations.

8. The plating solution of claim 1, wherein said metal salt further comprises nickel and said plating bath is an electroless nickel plating bath.

9. The plating solution of claim 8, wherein said plating solution is able to form a plating bath that comprises at least one of electroless nickel, electroless nickel with PTFE, electroless nickel with diamond, electroless nickel with silicon carbide, electroless nickel with visually detectable particles, electroless nickel with boron nitride particles, graphite, graphene, carbides, oxides, or fluorides.

10. The plating solution of claim 1, wherein the initial plating bath formed with said solution has a pH in a defined range, and upon replenishment, the replenished bath has a pH in the same range.

11. The plating solution of claim 1, wherein articles plated in a bath comprised of said solution include coatings with electroless nickel phosphorus and PTFE over a bath life of at least three metal turnovers.

12. The plating solution of claim 1, wherein articles plated in a bath comprised of said solution include coatings with at least one of the items selected from a group consisting of diamond, silicon carbide, boron nitride, PTFE, graphite, graphene, carbides, oxides, fluorides, and visually detectable particles wherein said detectable particles include at least one of insoluble, fluorescent or otherwise visually detectable particles.

13. A plating solution concentrate comprising, in defined concentrations:

a complexer, said complexer selected from the group consisting of lactic acid, malic acid, maleic anhydride, glycine, citric acid, citrates, glycolic acid or salts, succinic acid or salts, beta-alanine, EDTA, ammonium carbonate, ammonium chloride, propionic acid, tetra potassium pyrophosphate, and boric acid;

at least one pH adjuster; and at least one stabilizer for stabilizing a plating reaction;

wherein said plating solution concentrate is mixable with water to form an initial plating bath and is also usable in the same concentrations for replenishing said bath.

14. The concentrate of claim 13, further comprising a metal salt.

15. The concentrate of claim 13, further comprising reducing agent.

16. The concentrate of claim 15, further comprising a metal salt.

17. The concentrate of claim 13, further comprising at least one type of particulate matter stabilizer.

18. The concentrate of claim 13, wherein a pH of the initial bath is in a defined range and upon replenishment, the replenished bath has a pH in the same range.

19. The concentrate of claim 18, wherein said concentrate has a pH in the range of about 8.0-10.0.

20. The concentrate of claim 13, wherein articles plated in a bath comprised of said concentrate include coatings with at least one of the items selected from a group consisting of diamond, silicon carbide, boron nitride, PTFE, graphite, graphene, carbides, oxides, fluorides, and visually detectable particles, wherein said detectable particles include at least one of insoluble, fluorescent or otherwise visually detectable particles, and said visually detectability is related to at least one from the group consisting of phosphorescent, fluorescent, chemically and electronically detectable.

* * * * *